US012137771B2

(12) United States Patent
Rushbrook et al.

(10) Patent No.: US 12,137,771 B2
(45) **Date of Patent: *Nov. 12, 2024**

(54) ARTICLE OF FOOTWEAR WITH DYNAMIC SUPPORT

(71) Applicant: NIKE, Inc., Beaverton, OR (US)

(72) Inventors: Thomas J. Rushbrook, Portland, OR (US); Tiffany A. Beers, Portland, OR (US); Nathan T. Gilbreath, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/222,097

(22) Filed: Apr. 5, 2021

(65) Prior Publication Data

US 2021/0219651 A1 Jul. 22, 2021

Related U.S. Application Data

(60) Continuation of application No. 16/835,577, filed on Mar. 31, 2020, now Pat. No. 10,986,888, which is a (Continued)

(51) Int. Cl.
*A43B 3/34* (2022.01)
*A41B 1/08* (2006.01)

(Continued)

(52) U.S. Cl.
CPC ..... *A43B 3/34* (2022.01); *A41B 1/08* (2013.01); *A41D 1/002* (2013.01); *A41D 1/06* (2013.01);

(Continued)

(58) Field of Classification Search
CPC ..... A43B 5/02; A43B 5/06; A43B 5/0409; A43B 23/0125; A43B 23/0235;

(Continued)

(56) References Cited

U.S. PATENT DOCUMENTS 3,978,525 A 9/1976 Bothwell
4,741,115 A * 5/1988 Pozzobon ..... A43B 3/34 36/117.7

(Continued)

FOREIGN PATENT DOCUMENTS

CN 101217894 A 7/2008
CN 101642292 A 2/2010

(Continued)

OTHER PUBLICATIONS

"European Application Serial No. 22180252.3, Response filed Sep. 1, 2022 to Invitation to Remedy Deficiencies (R. 58 EPC) mailed Jul. 5, 2022", 5 pgs.

(Continued)

*Primary Examiner* — Bao-Thieu L Nguyen

(74) *Attorney, Agent, or Firm* — Schwegman, Lundberg & Woessner, P.A.

(57) ABSTRACT

An article of footwear with a dynamic support system that controls arrays of tiles in the upper of the footwear to adjust the level of support provided in different regions of the upper. Sensors in the sole of the footwear, in the upper of the footwear and/or in an article worn by the wearer of the footwear measure the level of stress or other characteristics and provide input to one or more microprocessors that control motors located in the sole or in the upper of the footwear. When the motors are activated, they may compress or loosen arrays of tiles to adjust the stiffness of the upper in one or more regions of the upper.

15 Claims, 32 Drawing Sheets

Related U.S. Application Data continuation of application No. 16/105,090, filed on Aug. 20, 2018, now Pat. No. 11,206,892, which is a continuation of application No. 15/197,191, filed on Jun. 29, 2016, now Pat. No. 10,070,683, which is a division of application No. 14/258,480, filed on Apr. 22, 2014, now Pat. No. 9,380,834.

(51) Int. Cl.

| | |
|---|---|
| ***A41D 1/00*** | (2018.01) |
| ***A41D 1/06*** | (2006.01) |
| ***A41D 13/06*** | (2006.01) |
| ***A41D 20/00*** | (2006.01) |
| ***A43B 5/00*** | (2022.01) |
| ***A43B 5/02*** | (2006.01) |
| ***A43B 5/06*** | (2022.01) |
| ***A43B 7/1405*** | (2022.01) |
| ***A43B 7/32*** | (2006.01) |
| ***A43B 23/02*** | (2006.01) |
| ***A43B 23/16*** | (2006.01) |
| ***G05B 15/02*** | (2006.01) |
| ***G05B 19/401*** | (2006.01) |

(52) U.S. Cl.

CPC ..... *A41D 13/065* (2013.01); *A41D 20/00* (2013.01); *A43B 5/002* (2013.01); *A43B 5/02* (2013.01); *A43B 5/025* (2013.01); *A43B 5/06* (2013.01); *A43B 7/141* (2013.01); *A43B 7/32* (2013.01); *A43B 23/0215* (2013.01); *A43B 23/0235* (2013.01); *A43B 23/0245* (2013.01); *A43B 23/026* (2013.01); *A43B 23/0265* (2013.01); *A43B 23/027* (2013.01); *A43B 23/0275* (2013.01); *A43B 23/028* (2013.01); *A43B 23/0295* (2013.01); *A43B 23/16* (2013.01); *G05B 15/02* (2013.01); *G05B 19/401* (2013.01); *G05B 2219/37399* (2013.01)

(58) Field of Classification Search

CPC . A43B 23/026; A43B 23/027; A43B 23/0275; A43B 23/0245; A43B 23/0265; A43B 23/0295; A43B 23/22; A43B 23/26; A43B 3/005; A43B 7/141

See application file for complete search history.

(56) References Cited

U.S. PATENT DOCUMENTS 4,771,556 A * 9/1988 Kim ..... A43C 11/00 446/404
4,843,740 A 7/1989 Walkhoff
4,907,354 A 3/1990 Benoit et al.
4,924,605 A * 5/1990 Spademan ..... A43C 11/00 36/114
4,958,459 A 9/1990 Davidson
4,999,932 A 3/1991 Grim
5,109,614 A 5/1992 Curry
5,125,171 A 6/1992 Stewart
5,373,651 A * 12/1994 Wood ..... A43B 3/34 36/114
5,500,952 A 3/1996 Keyes
5,535,531 A * 7/1996 Karabed ..... A43C 7/00 36/1
5,722,187 A 3/1998 Pamio et al.
5,896,590 A 4/1999 Fleisch
5,950,335 A * 9/1999 Okajima ..... A43B 5/0447 36/89
5,985,383 A * 11/1999 Allen ..... A43B 19/00 525/218
6,012,162 A 1/2000 Bullat
6,032,299 A 3/2000 Welsh
6,170,175 B1 * 1/2001 Funk ..... A43B 5/049 36/89
6,381,876 B2 5/2002 Krajcir
6,779,280 B2 8/2004 Wright et al.
6,951,033 B2 10/2005 Dainese
7,150,048 B2 12/2006 Buckman
7,225,563 B2 * 6/2007 Chen ..... A43B 3/26 36/55
7,370,440 B1 5/2008 Cole, III
7,386,947 B2 * 6/2008 Martin ..... A43C 11/165 36/117.6
7,540,100 B2 6/2009 Pawlus et al.
7,591,050 B2 * 9/2009 Hammerslag ..... A43C 11/00 36/50.5
7,752,774 B2 * 7/2010 Ussher ..... A43C 11/165 36/138
7,810,258 B2 10/2010 Narajowski et al.
7,836,608 B2 * 11/2010 Greene ..... B29D 35/126 428/53
7,849,525 B2 12/2010 Ghajar
8,104,196 B2 * 1/2012 Spinelli ..... A43B 3/24 36/15
8,151,488 B2 4/2012 Aveni
8,215,032 B2 7/2012 Sokolowski et al.
8,356,429 B2 * 1/2013 Eder ..... A43B 13/223 36/114
8,661,714 B2 * 3/2014 Sussmann ..... A43B 3/26 36/97
8,844,167 B2 9/2014 Greene
8,935,860 B2 * 1/2015 Torres ..... A43C 11/008 36/88
9,380,834 B2 * 7/2016 Rushbrook ..... A43B 23/0215
9,730,482 B2 8/2017 Allen et al.
10,034,512 B2 * 7/2018 Rushbrook ..... A41D 1/002
10,070,683 B2 * 9/2018 Rushbrook ..... A43B 23/0215
10,986,888 B2 * 4/2021 Rushbrook ..... A41B 1/08
11,206,892 B2 * 12/2021 Rushbrook ..... A43B 5/06
2002/0184790 A1 * 12/2002 Davis ..... A43D 1/027 36/1
2003/0177661 A1 9/2003 Tsai
2003/0182040 A1 9/2003 Davidson
2004/0181972 A1 9/2004 Csorba
2005/0102861 A1 * 5/2005 Martin ..... A43C 11/16 36/50.5
2006/0032090 A1 2/2006 Chen et al.
2006/0117600 A1 * 6/2006 Greene ..... A43B 13/141 36/9 R
2006/0185193 A1 * 8/2006 Pellegrini ..... A43C 1/00 36/50.1
2006/0196083 A1 * 9/2006 Martin ..... A43B 5/0401 36/50.5
2007/0000154 A1 * 1/2007 DiBenedetto ..... A61B 5/1038 36/132
2007/0006489 A1 * 1/2007 Case ..... A43D 1/027 36/132
2007/0011919 A1 * 1/2007 Case ..... A43B 1/0036 36/132
2007/0044346 A1 * 3/2007 Ungari ..... A43B 23/0235 36/136
2007/0068040 A1 * 3/2007 Farys ..... A43C 1/04 36/50.1
2007/0130799 A1 6/2007 Seliger et al.
2007/0260421 A1 * 11/2007 Berner ..... G01C 22/006 702/155
2008/0066346 A1 3/2008 Hammerslag et al.
2008/0083135 A1 * 4/2008 Hammerslag ..... A43C 11/165 36/50.1
2008/0168685 A1 7/2008 Kim et al.
2008/0301919 A1 12/2008 Ussher
2009/0183392 A1 7/2009 Shane
2009/0229144 A1 9/2009 Sussman
2009/0284368 A1 * 11/2009 Case, Jr. ..... G06Q 30/0639 36/114
2010/0036306 A1 * 2/2010 Lussier ..... A61F 5/0111 602/65
2010/0063778 A1 * 3/2010 Schrock ..... A61B 5/486 73/172

(56) References Cited

U.S. PATENT DOCUMENTS

| | | | | |
|---|---|---|---|---|
| 2010/0088927 | A1* | 4/2010 | Spinelli | A43B 13/36 36/15 |
| 2010/0154255 | A1* | 6/2010 | Robinson | A43B 5/001 36/25 R |
| 2010/0299959 | A1 | 12/2010 | Hammerslag et al. | |
| 2011/0030244 | A1 | 2/2011 | Motawi et al. | |
| 2011/0047684 | A1 | 3/2011 | Jan et al. | |
| 2011/0258876 | A1 | 10/2011 | Baker et al. | |
| 2011/0277349 | A1 | 11/2011 | Kim | |
| 2011/0308113 | A1* | 12/2011 | Hartford | A43B 5/06 36/136 |
| 2012/0000091 | A1 | 1/2012 | Cotterman et al. | |
| 2012/0011744 | A1 | 1/2012 | Bell et al. | |
| 2012/0110870 | A1* | 5/2012 | Haouari | A43B 3/24 36/83 |
| 2012/0180341 | A1 | 7/2012 | Crowley, II et al. | |
| 2012/0251079 | A1 | 10/2012 | Meschter et al. | |
| 2012/0291563 | A1* | 11/2012 | Schrock | A43B 3/00 73/862.041 |
| 2012/0291564 | A1* | 11/2012 | Amos | A43B 13/141 73/862.041 |
| 2013/0104429 | A1* | 5/2013 | Torres | A43C 1/003 36/136 |
| 2013/0213144 | A1 | 8/2013 | Rice et al. | |
| 2013/0213147 | A1 | 8/2013 | Rice et al. | |
| 2014/0026440 | A1 | 1/2014 | Beers et al. | |
| 2014/0070042 | A1 | 3/2014 | Beers et al. | |
| 2014/0157627 | A1 | 6/2014 | Smaldone et al. | |
| 2014/0277631 | A1* | 9/2014 | Rice | A43B 13/12 36/103 |
| 2014/0305006 | A1 | 10/2014 | Azoulay | |
| 2015/0059206 | A1* | 3/2015 | Lovett | A43C 11/004 12/142 R |
| 2016/0306339 | A1 | 10/2016 | Rushbrook et al. | |
| 2016/0309830 | A1 | 10/2016 | Rushbrook et al. | |
| 2019/0082773 | A1* | 3/2019 | Rushbrook | G05B 15/02 |
| 2020/0221814 | A1 | 7/2020 | Rushbrook et al. | |
| 2022/0110402 | A1 | 4/2022 | Rushbrook et al. | |

FOREIGN PATENT DOCUMENTS

| | | | |
|---|---|---|---|
| CN | 102014682 | A | 4/2011 |
| CN | 102958395 | A | 3/2013 |
| CN | 202999456 | U | 6/2013 |
| CN | 106455747 | A | 2/2017 |
| CN | 106455747 | B | 4/2018 |
| CN | 108378455 | A | 8/2018 |
| CN | 108391892 | A | 8/2018 |
| CN | 108378455 | B | 8/2020 |
| CN | 108391892 | | 7/2021 |
| EP | 3133947 | B1 | 11/2018 |
| EP | 3494821 | | 7/2022 |
| FR | 2924577 | A1 | 6/2009 |
| GB | 1434141 | A | 5/1976 |
| JP | 2004352113 | A | 12/2004 |
| WO | WO-2009071652 | A1 | 6/2009 |
| WO | WO-2010004538 | A1 | 1/2010 |
| WO | WO-2014036374 | A1 | 3/2014 |
| WO | WO-2015163982 | A1 | 10/2015 |

OTHER PUBLICATIONS

"European Application Serial No. 22180252.3, Extended European Search Report mailed Dec. 9, 2022", 12 pgs.

U.S. Appl. No. 17/559,035, filed Dec. 22, 2021, Article of Footwear With Dynamic Support.

"U.S. Appl. No. 14/258,480, Examiner Interview Summary mailed Feb. 18, 2016", 3 pgs.

"U.S. Appl. No. 14/258,480, Non Final Office Action mailed Nov. 20, 2015", 19 pgs.

"U.S. Appl. No. 14/258,480, Notice of Allowance mailed Mar. 7, 2016", 8 pgs.

"U.S. Appl. No. 14/258,480, Response filed Feb. 22, 2016 to Non Final Office Action mailed Nov. 20, 2015", 14 pgs.

"U.S. Appl. No. 14/258,480, Response filed Sep. 28, 2015 to Restriction Requirement mailed Jul. 30, 2015", 12 pgs.

"U.S. Appl. No. 14/258,480, Restriction Requirement mailed Jul. 30, 2015", 7 pgs.

"U.S. Appl. No. 15/197,020, Non Final Office Action mailed Nov. 1, 2017", 10 pgs.

"U.S. Appl. No. 15/197,020, Notice of Allowability mailed Apr. 19, 2018", 2 pgs.

"U.S. Appl. No. 15/197,020, Notice of Allowance mailed Apr. 4, 2018", 7 pgs.

"U.S. Appl. No. 15/197,020, Response Filed Jan. 31, 2018 to Non Final Office Action mailed Nov. 1, 2017", 11 pgs.

"U.S. Appl. No. 15/197,191, Non Final Office Action mailed Nov. 22, 2017", 19 pgs.

"U.S. Appl. No. 15/197,191, Notice of Allowance mailed May 14, 2018", 7 pgs.

"U.S. Appl. No. 15/197,191, Response filed Feb. 22, 2018 to Non Final Office Action mailed Nov. 22, 2017", 13 pgs.

"U.S. Appl. No. 15/197,191, Response filed Oct. 9, 2017 to Restriction Requirement mailed Aug. 7, 2017", 7 pgs.

"U.S. Appl. No. 15/197,191, Restriction Requirement mailed Aug. 7, 2017", 8 pgs.

"U.S. Appl. No. 16/105,090, Examiner Interview Summary mailed Jul. 14, 2020", 3 pgs.

"U.S. Appl. No. 16/105,090, Non Final Office Action mailed Jun. 22, 2020", 27 pgs.

"U.S. Appl. No. 16/105,090, Preliminary Amendment Filed Dec. 6, 2018", 6 pgs.

"U.S. Appl. No. 16/105,090, Response filed May 20, 2020 to Restriction Requirement mailed Mar. 20, 2020", 8 pgs.

"U.S. Appl. No. 16/105,090, Response filed Nov. 23, 2020 to Non Final Office Action mailed Jun. 22, 2020", 12 pgs.

"U.S. Appl. No. 16/105,090, Restriction Requirement mailed Mar. 20, 2020", 7 pgs.

"U.S. Appl. No. 16/835,577, Examiner Interview Summary mailed May 7, 2020".

"U.S. Appl. No. 16/835,577, Examiner Interview Summary mailed Sep. 23, 2020", 3 pgs.

"U.S. Appl. No. 16/835,577, Final Office Action mailed Aug. 25, 2020", 21 pgs.

"U.S. Appl. No. 16/835,577, Non Final Office Action mailed Apr. 20, 2020".

"U.S. Appl. No. 16/835,577, Notice of Allowance mailed Dec. 16, 2020", 9 pgs.

"U.S. Appl. No. 16/835,577, Response filed Oct. 23, 2020 to Final Office Action mailed Aug. 25, 2020", 8 pgs.

"U.S. Appl. No. 16/835,577, Supplemental Notice of Allowability mailed Mar. 31, 2021", 4 pgs.

"Chinese Application Serial No. 201580033622.7, Response filed Nov. 17, 2017 to Office Action mailed Jun. 2, 2017", w/ claims in English, 67 pgs.

"Chinese Application Serial No. 201810309298.2, Office Action mailed May 21, 2020", W/English Translation, 12 pgs.

"Chinese Application Serial No. 201810312380.0, Office Action mailed Feb. 28, 2019", w/ English summary, 6 pgs.

"Chinese Application Serial No. 201810312380.0, Office Action mailed Sep. 27, 2019", W/English Translation, 7 pgs.

"Chinese Application Serial No. 201810312380.0, Response filed Feb. 12, 2020 to Office Action mailed Sep. 27, 2019", w/ English claims, 16 pgs.

"Chinese Application Serial No. 201810312380.0, Response filed Sep. 5, 2019 to Office Action mailed Feb. 28, 2019", w/ English claims, 17 pgs.

"Chinese Application Serial No. 201810312380.0, Voluntary Amendment filed Dec. 6, 2018", w/ English claims, 21 pgs.

"Chinese Application Serial No. 201580033622.7, Office Action mailed Jun. 2, 2017", w/ brief summary from agent's letter, 6 pgs.

"European Application Serial No. 15710090.0, Response filed Apr. 20, 2017 to Communication Pursuant to Rules 161(1) and 162 EPC mailed Dec. 20, 2016", 13 pgs.

(56) References Cited

OTHER PUBLICATIONS

"European Application Serial No. 18204546.8, Extended European Search Report mailed May 10, 2019", 8 pgs.
"European Application Serial No. 18204546.8, Response filed Dec. 12, 2019 to Extended European Search Report mailed May 10, 2019", 40 pgs.
"International Application Serial No. PCT/US2015/019382, International Preliminary Report on Patentability mailed Nov. 3, 2016", 10 pgs.
"International Application Serial No. PCT/US2015/019382, International Search Report mailed Jun. 1, 2015", 6 pgs.
"International Application Serial No. PCT/US2015/019382, Written Opinion mailed Jun. 1, 2015", 8 pgs.
"Chinese Application Serial No. 201810309298.2, Response filed Dec. 7, 2020 to Office Action mailed May 21, 2020", w English Claims, 15 pgs.
"Application Serial No. 16 105,090, Final Office Action mailed Jan. 27, 2021", 19 pgs.
"Application Serial No. 16 105,090, Appeal Brief filed Jun. 29, 2021", 24 pgs.
"U.S. Appl. No. 16/105,090, Notice of Allowance mailed Aug. 19, 2021", 8 pgs.
"U.S. Appl. No. 17/559,035, Response filed Nov. 20, 2023 to Final Office Action mailed Aug. 22, 2023", 10 pgs.
"U.S. Appl. No. 17/559,035, Non Final Office Action mailed May 1, 2023", 12 pgs.
"U.S. Appl. No. 17/559,035, Examiner Interview Summary mailed May 30, 2023", 2 pgs.
"U.S. Appl. No. 17/559,035, Response filed Aug. 1, 2023 to Non Final Office Action mailed May 1, 2023", 10 pgs.
"U.S. Appl. No. 17/559,035, Final Office Action mailed Aug. 22, 2023", 19 pgs.
"U.S. Appl. No. 17/559,035, Non Final Office Action mailed Feb. 7, 2024", 9 pgs.
"European Application Serial No. 22180252.3, Response filed Aug. 8, 2023 to Extended European Search Report mailed Dec. 9, 2022", 17 pgs.
"U.S. Appl. No. 17/559,035, Response filed Aug. 7, 2024 to Non Final Office Action mailed Feb. 7, 2024", 9 pgs.
"U.S. Appl. No. 17/559,035, Notice of Allowance mailed Aug. 22, 2024", 7 pgs.

* cited by examiner

ARTICLE OF FOOTWEAR WITH DYNAMIC SUPPORT

CROSS-REFERENCE TO RELATED APPLICATIONS

This application is a continuation of U.S. patent application Ser. No. 15/197,191, filed Jun. 29, 2016, which application is a divisional of Rushbrook et al., U.S. patent application Ser. No. 14/258,480, filed Apr. 22, 2014, issued on Jul. 5, 2016 as U.S. Pat. No. 9,380,834, both of which are hereby incorporated by reference in their entireties.

BACKGROUND

The present embodiments relate to an article of footwear, and in particular to an article of footwear that provides dynamic support and stability as the wearer engages in a particular athletic or recreational activity Typical athletic shoes have two major components, an upper that provides the enclosure for receiving the foot, and a sole secured to the upper. The upper is generally adjustable using laces or other fastening means to secure the shoe properly to the foot, and the sole has the primary contact with the playing surface. The primary functions of the upper are to provide protection, stability and support to the wearer's foot tailored to the particular activity the wearer is engaged in, while maintaining an appropriate level of comfort.

SUMMARY

This summary is intended to provide an overview of the subject matter of the present embodiments, and is not intended to identify essential features or key elements of the subject matter, nor is it intended to be used to determine the scope of the claimed embodiments. The proper scope of the embodiments may be ascertained from the detailed description of the embodiments provided below, the figures referenced therein, and the claims.

Generally, the embodiments of the articles of footwear with a dynamic support system disclosed herein have regions or portions of the footwear whose flexibility, level of support, stiffness and/or impact resistance can be controlled by activating the dynamic support system in response to input from one or more sensors. As described below, the sensors may be placed in various positions of the article of footwear, depending upon the specific sports or recreational activity the article of footwear is intended for, or could be placed on wrist bands, headbands, shorts, shirts or other articles of apparel worn by a user. For example, the article of footwear may be a walking shoe, tennis shoe, a running shoe, a training shoe, a soccer shoe, a football shoe, a basketball shoe, an all-purpose recreational sneaker, a volleyball shoe or a hiking boot.

In one aspect, the dynamic support system in the article of footwear has at least one sensor in communication with a microprocessor. The sensor is embedded in either the sole or the upper of the article of footwear. It also has an array of tiles embedded in the upper with at least one cable laced through the array of tiles and wound around a reel. It has a reversible motor attached to the reel such that the reversible motor can rotate the reel in a first direction to pull in the cable to compress the array of tiles and in a second direction opposite to the first direction to loosen the array of tiles. The microprocessor is in communication with the reversible motor and can activate the reversible motor to rotate the reel in the first direction or in a the second direction according to an algorithm that receives input(s) from the sensor(s) and, in response to the input(s), determines whether to rotate the reel in the first direction to pull in the cable to compress the array of tiles or to rotate the reel in the second direction to loosen the array of tiles.

In another aspect, the dynamic support system includes an array of tiles embedded in a fabric portion of the upper and a microprocessor. It also has stress sensors such as pressure sensor(s) in the sole reporting to the microprocessor and/or tension sensor(s) in the upper reporting to the microprocessor. It has cables laced through the array of tiles and mechanically connected to a reel attached to a reversible motor. When the microprocessor receives input from a sensor, it can control the reversible motor to rotate the reel to compress the array of tiles according to input(s) received from that sensor.

In another aspect, the dynamic support system uses microprocessors and sensors embedded in both a left article of footwear and a right article of footwear. The sensors in both the left article of footwear and the right article of footwear communicate with both the microprocessor in the left article of footwear and the microprocessor in the right article of footwear. Each article of footwear also has a reversible motor in communication with its microprocessor. Each reversible motor can rotate an attached reel. Each article of footwear has an array of tiles in its upper that is mechanically connected to the its reel by a cable system The microprocessors are configured to receive inputs from both the first pressure sensor and the second pressure sensor, and to respond to these inputs by activating their respective motors to compress the arrays of tiles.

In another aspect, a dynamic support system for an article of footwear has at least one sensor located in the article of footwear and at least one other sensor located in an article (other than the article of footwear) that is worn by a wearer of the article of footwear. A microprocessor in the article of footwear is in communication with both sensors over a personal area wireless network. When the microprocessor receives an input from a sensor located in the article of footwear and another input from a sensor located in the article worn by the wearer of the article of footwear, it responds to these inputs by determining whether to activate a motor to compress an array of tiles in a fabric portion of the article of footwear In another aspect, an article of footwear has a plurality of diamond-shaped tiles arranged in an array of rows and columns. It has a first set of cables laced diagonally through the diamond-shaped tiles from one vertex to an opposite vertex of the diamond shaped tiles in one of (a) alternate rows of the array of rows and columns and (b) alternate columns in the array of rows and columns. The first set of cables is mechanically connected to a first reel attached to a first reversible motor. It has a stress sensor in one of the upper and the sole that is in communication with a microprocessor. The microprocessor is configured to control the first reversible motor to compress the tiles when it receives an input from the sensor indicating that a detected stress level is above a predetermined stress level.

The following U.S. patent applications disclose sensor systems for use in articles of footwear, and are incorporated by reference herein in their entirety: U.S. Patent Applications Pub. Nos. US 2012/0291564; US 2012/0291563; US 2010/0063778; US 2013/0213144; US 2013/0213147; and US 2012/0251079.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Generally, this application discloses articles of footwear bearing a dynamic support system. The dynamic support system adjusts the level of support and flexibility of various portions of the article of footwear dynamically, so as to provide additional support, stability and protection when the dynamic support system determines that such additional support, protection and stability is needed, and to maintain a flexible configuration when such additional support, protection or stability is not needed. The dynamic support system may react in response to an actual event, such as a player stressing a particular region of the article of footwear, or may be activated in anticipation of a stress in a particular region of the article of footwear.

Figure 1:
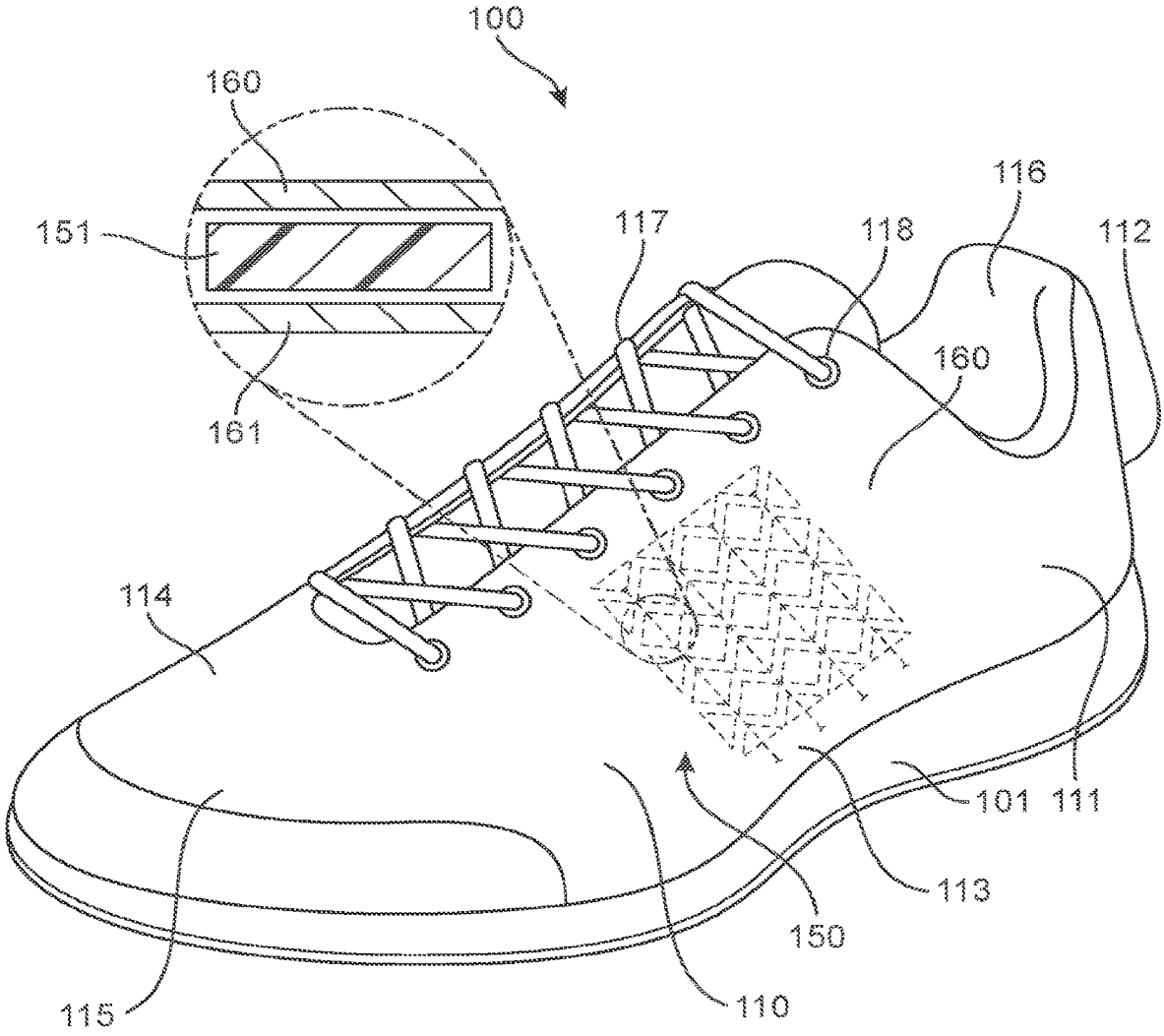
FIG. 1 is a schematic diagram of an embodiment of an article of footwear with an example of a dynamic support system.

FIG. 1 is a schematic diagram of a generic article of footwear 100 with an example of a dynamic support system. The article of footwear 100 includes a sole 101, which provides the primary ground-contacting surface, and an upper 110, which receives and encloses the wearer's foot and thus provides support, stability and protection to the wearer's foot. Upper 110 has a side heel portion 111, a rear heel portion 112, an instep or midfoot portion 113, a forefoot portion 114 and a toe portion 115. Upper 110 has an ankle opening 116 for receiving the wearer's foot, and laces 117 laced through eyelets 118 to tighten upper 110 around the wearer's foot.

An example of an embodiment of a dynamic support system is shown as an array 150 of tiles 151. The array 150 of tiles 151 is shown on the lateral side of the article of footwear, between the eyelets 118 and the sole 101 of the article of footwear. The dynamic support system includes additional components, such as cables and one or more harnesses, reels, motors, sensors, microprocessors and programs. These are described below in reference to certain of the figures below.

In some embodiments, array 150 of tiles 151 may be covered by an outer layer of fabric 160, as shown in the blow-up of a cross-section of the upper in FIG. 1. FIG. 1 also shows that an inner layer of fabric 161 may also be used. Outer layer 160 may be used to protect array 150 from sand, dirt, debris, water or other materials that might interfere with the operation of array 150. Inner layer 161 may be used to provide a more comfortable surface for contacting the inner side of the upper to the wearer's foot.

Upper 110 may be generally fabricated from materials such as fabric, leather, woven or knitted materials, mesh, thermoplastic polyurethane, or other suitable materials, or from combinations of these materials. In some embodiments, upper 110 may also have reinforcing strips or panels in certain portions of the upper, such as around the ankle opening, at the eyelets or in the front of the toe region. For convenience, the upper material and layers of the upper material are referred to generically in this specification as a "fabric," but the term should be understood to encompass any material that may be used to fabricate the upper or any portion of the upper.

As the wearer of the article of footwear engages in athletic or recreational activities, the wearer may put stress on his or her forefoot, instep, ankle, heel, or on the medial or lateral sides of the footwear, for example. During those instants when a part of the wearer's foot is under stress, increased support may be beneficial in a corresponding portion of the footwear. At the same time, the flexibility of other portions of the footwear may be maintained. When the foot is no longer under significant stress, for example when the wearer is sitting, standing or walking, the dynamic support system may relax back to its initial unstressed condition.

Various kinds of stress sensors may be used with a dynamic support system. For example, in some embodiments, the dynamic support system may use piezoelectric sensors as pressure sensors in the sole of the article of footwear. In some embodiments it may also use strain gauge sensors to measure the tension in the fabric of the upper. It may also use proximity sensors to detect an impending impact, or accelerometers to detect certain motions by the person wearing the articles of footwear.

For purposes of illustration, FIG. 1 depicts a dynamic support system disposed on a particular portion of upper 110 on the side of the midfoot region. However, in other embodiments, the location of the dynamic support system can vary. With reference to the portions of an article of footwear identified in FIG. 1, as an example a basketball player may prefer to have dynamic support at the side of the heel portion 111 and towards the rear of midfoot portion 113. As another example, a soccer player may prefer to have dynamic support around the toe region 115 and impact protection on the medial side of the forefoot 114. A runner may prefer to have increased support around the ankle during certain portions of his or her stride. A person undergoing training with a variety of exercise equipment and weights may prefer to have a shoe that reacts differently when he or she is engaged in weightlifting compared to when he or she is exercising on a rowing machine or running on a treadmill.

As discussed in further detail below, the dynamic support system uses an array of tiles embedded in or on the material of upper 110. The tiles are connected by a series of cables to one or more reels or spools that may be rotated by one or more reversible motors positioned in, for example, the back of the heel 112, the sole 101 or on the sides of the footwear. The motors are controlled by one or more microprocessors placed, for example, in the sole 101 or in the back of the heel 112, as described below. The microprocessor is in wired or wireless communication with sensors positioned, for example, in the sole or in the upper, or even elsewhere on or around the wearer's body, as described below. In some embodiments, the tiles and the cables may be held in place between an outer layer of fabric and an inner layer of fabric.

Figure 2:
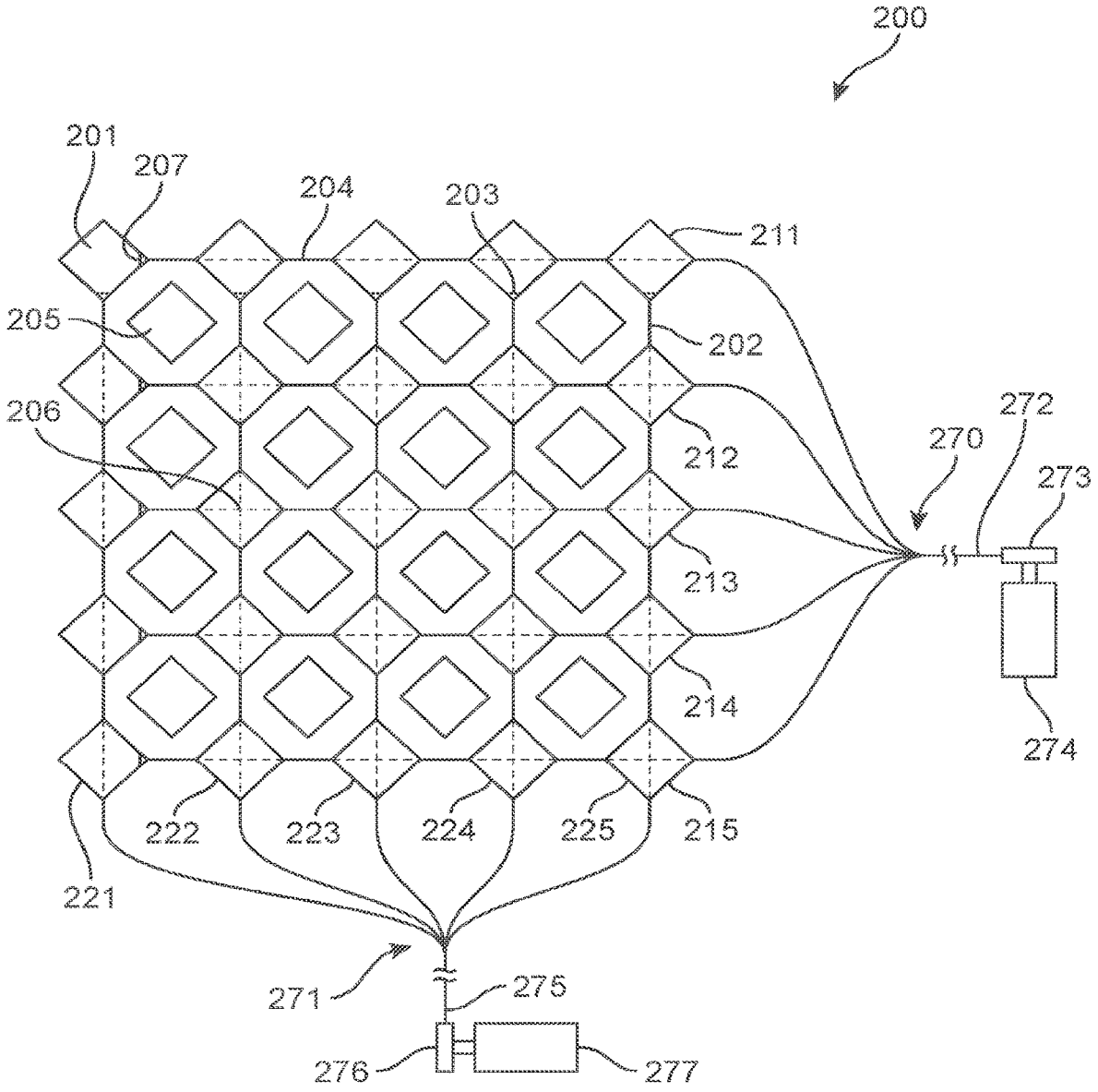
FIG. 2 is a schematic diagram of an embodiment of the dynamic support system.

FIG. 2 is an example of an embodiment of a dynamic support system, shown in isolation from an article of footwear. FIG. 2 shows an array 200 of diamond-shaped tiles 201 connected in columns and rows by vertical cables 202 and horizontal cables 204. In some embodiments, the cables are laced through alternating columns and rows. Vertical cables 202 and horizontal cables 204 cross in the middle 206 of tiles 201 (as discussed below with reference to FIGS. 3 and 4). In this embodiment, every other row and every other column of tiles 205 is not connected to either vertical cables 202 or horizontal cables 204, as shown in FIG. 2. Vertical cables 202 may be connected to endpoints 203 at, for example, the bottom vertex of the top row of tiles 201. Horizontal cables 204 may be connected, for example, to endpoints 207 at the left-hand column of tiles 201.

Horizontal cables 204 are gathered in a harness 270, which is attached to horizontal end cable 272. End cable 272 winds around reel 273. Reel 273 can be rotated in one direction by reversible motor 274 to pull row of tiles 211, row of tiles 212, row of tiles 213, row of tiles 214 and row of tiles 215 to compress the array of tiles. Reel 273 can be rotated in the opposite direction by reversible motor 274 to relax the tension on harness 270 and on horizontal cables 204 and allow the tiles to move back to their initial positions.

In the same way, vertical cables 202 are gathered in a harness 271, which is attached to vertical end cable 275. End cable 275 winds around reel 276. Reel 276 can be rotated in one direction by reversible motor 277 to pull row of tiles 221, row of tiles 222, row of tiles 223, row of tiles 224 and row of tiles 225 to compress the array of tiles. Reel 276 can be rotated in the opposite direction by reversible motor 277 to relax the tension on harness 271 and on vertical cables 202 and allow the tiles to move back to their initial positions.

As described below with reference to succeeding figures, when vertical cables 202 are pulled from the bottom, top row 211 of tiles is pulled down so that it abuts the next row 212 of tiles. As vertical cables 202 are pulled down further, row 212 of tiles abut row 213 of tiles. As vertical cables 202 are pulled down even further, row 213 of tiles abuts row 214 of tiles, then row 214 is pulled down so that it abuts row 215 of tiles. Row 215 of tiles may be fixed so that row 214 may be pulled against row 215 without further movement. In this manner, array of tiles 200 may be compressed vertically, thus providing increased stiffness, stability, support and impact protection.

In the same way, when horizontal cables 204 are pulled to the right, leftmost column of tiles 221 is pulled against column 222 of tiles, which is pulled against column 223 of tiles, which is pulled against column 224 of tiles, which is pulled against column 225 of tiles. Column 225 of tiles may be fixed so that column 224 may be pulled against column 225 without further movement. In this manner, array of tiles 200 may be compressed horizontally, thus providing increased stiffness, stability, support and impact protection.

In some embodiments, to provide maximum stability, both vertical cables 202 and horizontal cables 204 may be pulled by their respective reversible motors 274 and 277 to compress tiles 201 both horizontally and vertically . . . .

Although the tiles are shown in FIG. 2 and in other figures in this specification as being diamond-shaped, triangular or rectangular, other shapes of tiles such as hexagonal, oval, circular may also be used. In some cases, the tiles may have irregular shapes. Moreover, although the tiles are shown in the figures as having generally uniform sizes, the tiles do not need to be of uniform size and may indeed have different sizes according to the specific application.

Figure 3:
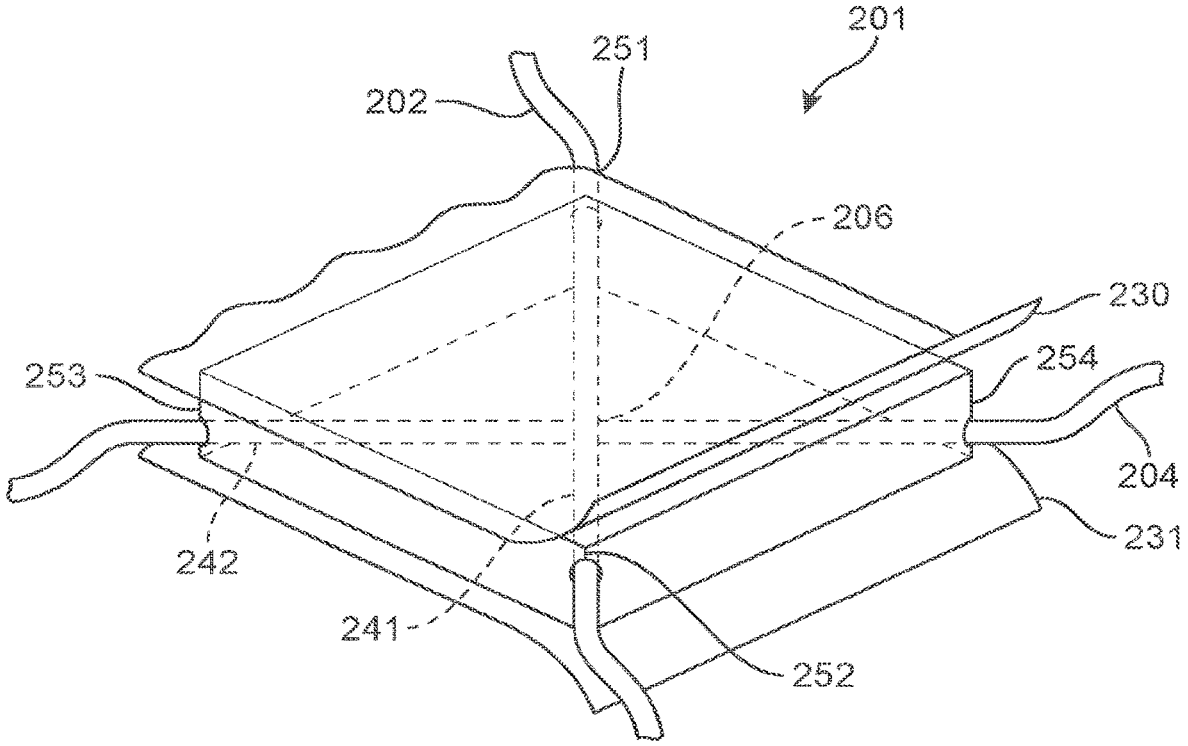
FIG. 3 is a schematic diagram showing how cables may be laced through tiles of the dynamic support system.

FIG. 3 is an illustration showing how vertical cable 202 and horizontal cable 204 may cross in the middle of a tile 201. As shown in FIG. 3, in some embodiments, vertical cable 202 traverses tile 201 through a passageway 241 extending diagonally from one corner 251 of tile 201 to its opposite corner 252. In some embodiments, horizontal cable 204 traverses tile 201 through a passageway 242 extending diagonally from corner 253 to its opposite corner 254. In the orientation shown, passageway 241 is displaced in the direction normal to the surface of the tile from passageway 242, such that passageway 241 crosses over passageway 242 in the middle of tile 201, but does not actually intersect passageway 242. FIG. 3 also shows that tile 201 is held between fabric 230 on one side of tile 201 and fabric 231 on the other side of tile 201.

Figure 4:
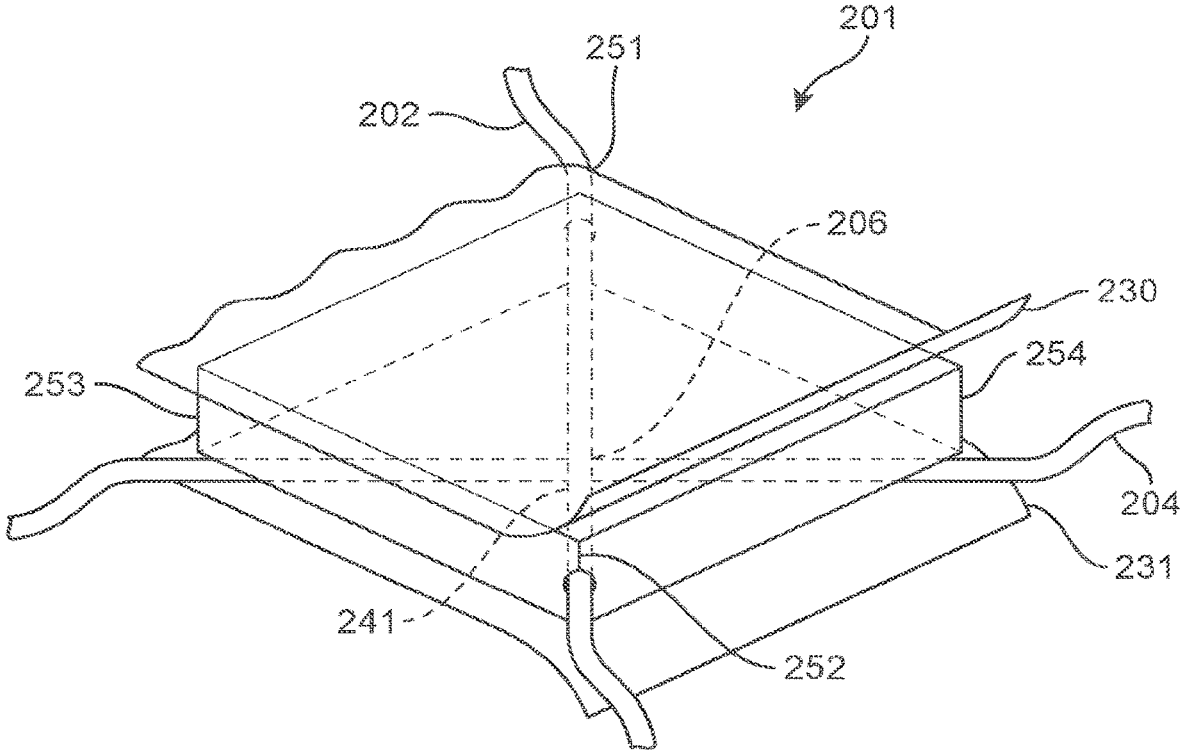
FIG. 4 is a schematic diagram showing an alternative embodiment for lacing the cables in the dynamic support system.

It should be understood that in other embodiments, alternative arrangements of associating cables and tiles could be used. For example, in some alternative embodiments, one or more cables could pass between a tile and a fabric, rather than passing through channels in the tile. FIG. 4 is an alternative embodiment showing vertical cable 202 traversing tile 201 through passageway 241 and horizontal cable 204 traversing under tile 201, between tile 201 and fabric 231.

Figure 5:
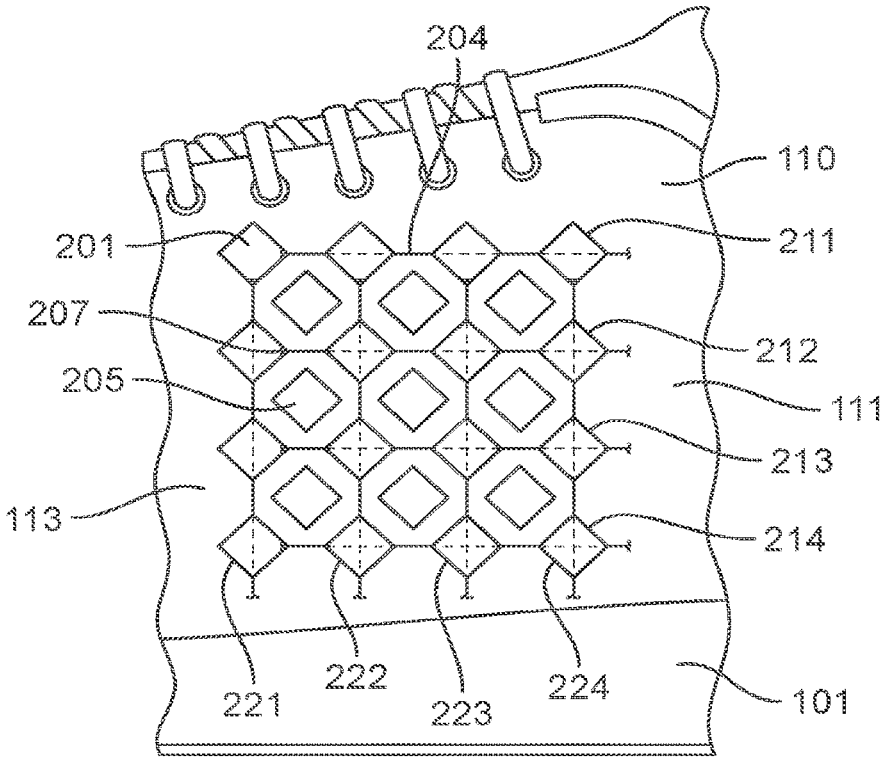
FIG. 5 is a schematic diagram showing an embodiment of an array of tiles in its initial relaxed state.

FIG. 5 is a schematic diagram showing an array of tiles similar to the array of FIG. 2 as it may be applied the side of the instep region of an article of footwear. For clarity, the array of tiles and the cables are not shown in phantom in FIG. 5 or in many of the succeeding figures, although they would typically be covered by an outer fabric. Such an outer fabric should be considered to be present in most embodiments disclosed herein, although it is not absolutely necessary. Also, for the same reason, the cable harnesses, reels and motors shown in FIG. 2 are not shown in FIG. 5 or several of the succeeding figures, but such cable harnesses, reels and motors would also be used in the other embodiments described in this specification.

Figure 6:
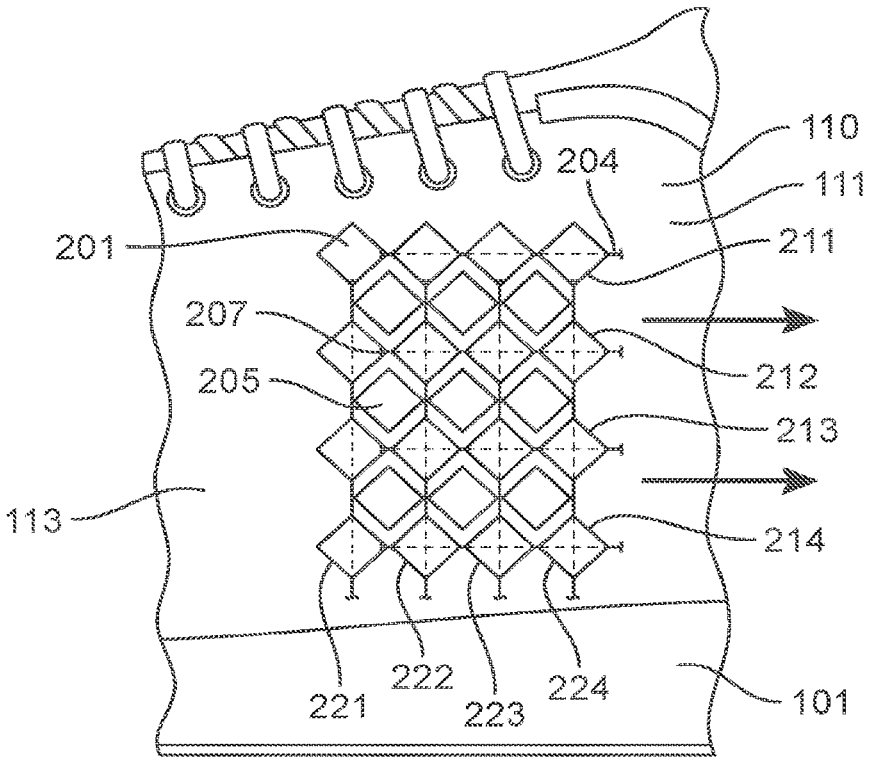
FIG. 6 shows the array of tiles of FIG. 5 after they have been compressed horizontally.

FIG. 5 illustrates the array of tiles in its initial relaxed state, positioned on the side of an upper 110 of an article of footwear, in a region bridging the side of the heel portion 111 and the rear of midfoot portion 113. FIG. 6 illustrates the array of tiles after motor 274 (not shown in FIGS. 5 and 6) has been activated to pull horizontal cables 204 laterally towards the heel end of the upper, and compress the array of tiles laterally. As described above, each of horizontal cables 204 is attached to the leftmost tile in row of tiles 211, row of tiles 212, row of tiles 213 and row of tiles 214. When motor 274 is activated, it pulls on endpoints 207 and thus pulls the tiles in row of tiles 211, row of tiles 212, row of tiles 213 and row of tiles 214 to the right. Column of tiles 221, column of tiles 222 and column of tiles 223 thus move to the right and are pressed against column of tiles 224, which is fixed. This movement of column of tiles 221, column of tiles 222 and column of tiles 223 thus serves to compress the array, as shown in FIG. 6. The compressed array provides additional support, stability and protection compared to the array in its initial state.

In this example, the motor and reel may be located at the back of the heel of upper 110. Cables 204 are attached to a harness such as harness 270 shown in FIG. 2. These cables may be routed between fabric layers (such as fabric layer 230 and fabric layer 231 shown in FIGS. 3 and 4) to be attached to end cables such as end cable 272 shown in FIG. 2. The cables may be further wound around a reel such as reel 273 shown in FIG. 2 by a reversible motor such as reversible motor 274 shown in FIG. 2.

Figure 7:
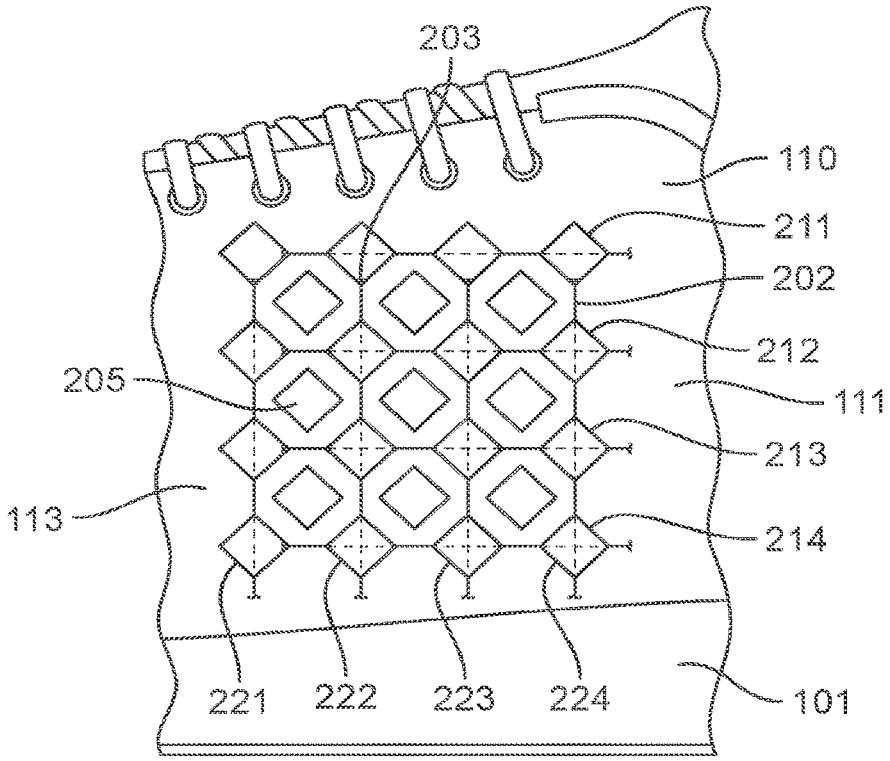
FIG. 7 is a schematic diagram showing an embodiment of an array of tiles in its initial relaxed state.
Figure 8:
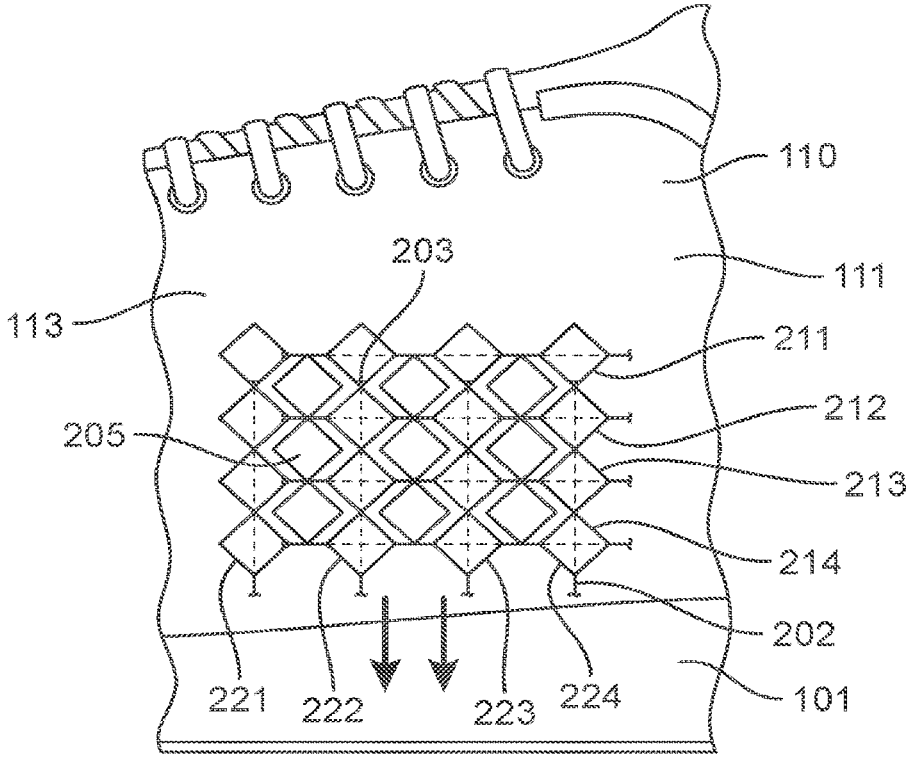
FIG. 8 shows the array of tiles of FIG. 7 after they have been compressed vertically.

The array of tiles shown in FIG. 5 may also be compressed vertically, as shown in FIGS. 7 and 8. FIG. 7 again illustrates the array of tiles in its initial relaxed state, and FIG. 8 illustrates the array of tiles after motor 277 (not shown in FIGS. 7 and 8) has been activated to pull vertical cables 202 down towards the sole 101, and compress the array of tiles vertically. As described above, each of vertical cables 202 is attached to the topmost tile in column of tiles 221, column of tiles 222, column of tiles 223 and column of tiles 224. When motor 277 is activated, it pulls endpoints 203 down and thus pulls down the tiles in row of tiles 211, row of tiles 212 and row of tiles 213 against the row of tiles 214 (which are fixed) to compress the array as shown in FIG. 8. The compressed array provides additional support, stability and protection compared to the array in its initial state.

In this example, motor 277 and reel 276 may be located in the sole. Cables 202 and harness 271 may be routed between fabric layers 230 and 231 (shown in FIGS. 3 and 4; not shown in FIGS. 7 and 8) to be attached to end cable 275 and wound around reel 276 by reversible motor 277.

Figure 9:
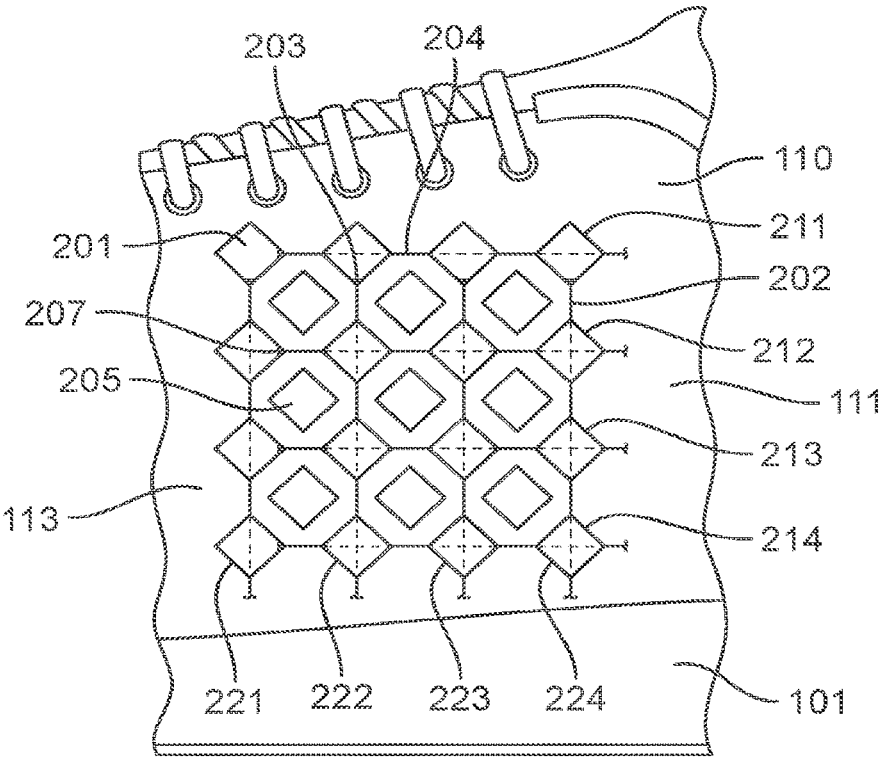
FIG. 9 is a schematic diagram showing an embodiment of an array of tiles in its initial relaxed state.
Figure 10:
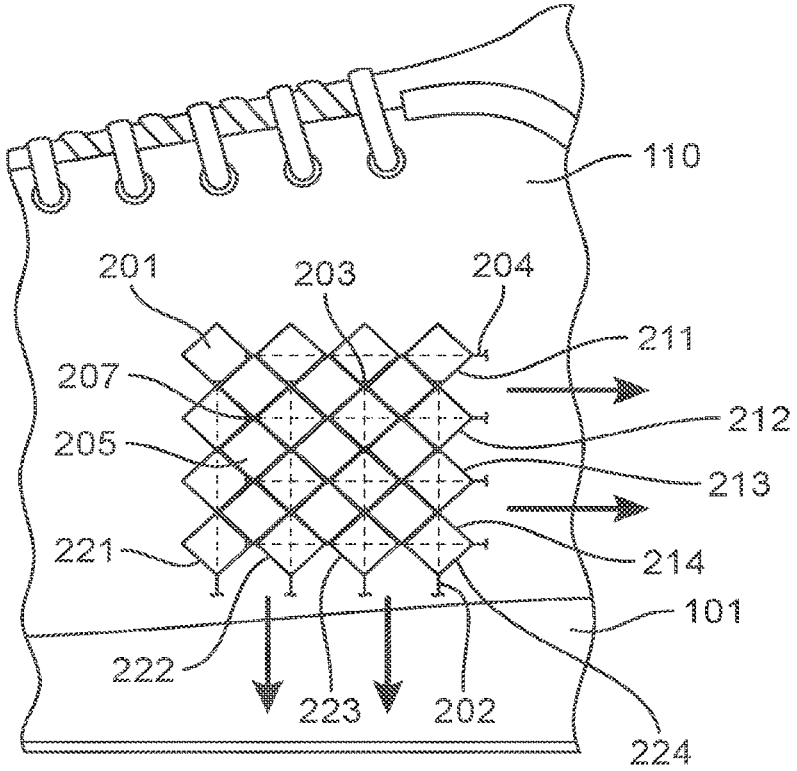
FIG. 10 shows the array of tiles of FIG. 9 after they have been compressed both vertically and horizontally.

The array of FIG. 2 may also be compressed both horizontally and vertically, as shown in FIGS. 9 and 10. When both motor 274 and motor 277 are activated, reel 273 pulls on endpoints 207 and thus pulls the tiles in row of tiles 211, row of tiles 212, row of tiles 213 and row of tiles 214 to the right to compress the array horizontally as shown in FIG. 10, while reel 276 pulls downwards on endpoints 203 and thus pulls the tiles in column of tiles 221, column of tiles 222, column of tiles 223 and column of tiles 224 downwards to compress the array as shown in FIG. 10. This dual action provides maximum support and stability by compressing the tiles such that they form a solid array of tiles with no or minimal gaps between the tiles. The tiles in row 214 are constrained to move horizontally, but not vertically, and the tiles in column 224 are constrained to move vertically but not horizontally, except for the corner tile. This tile, which is the end tile for row 214 and for column 224, is fixed so that it does not move in either direction.

Figure 11:
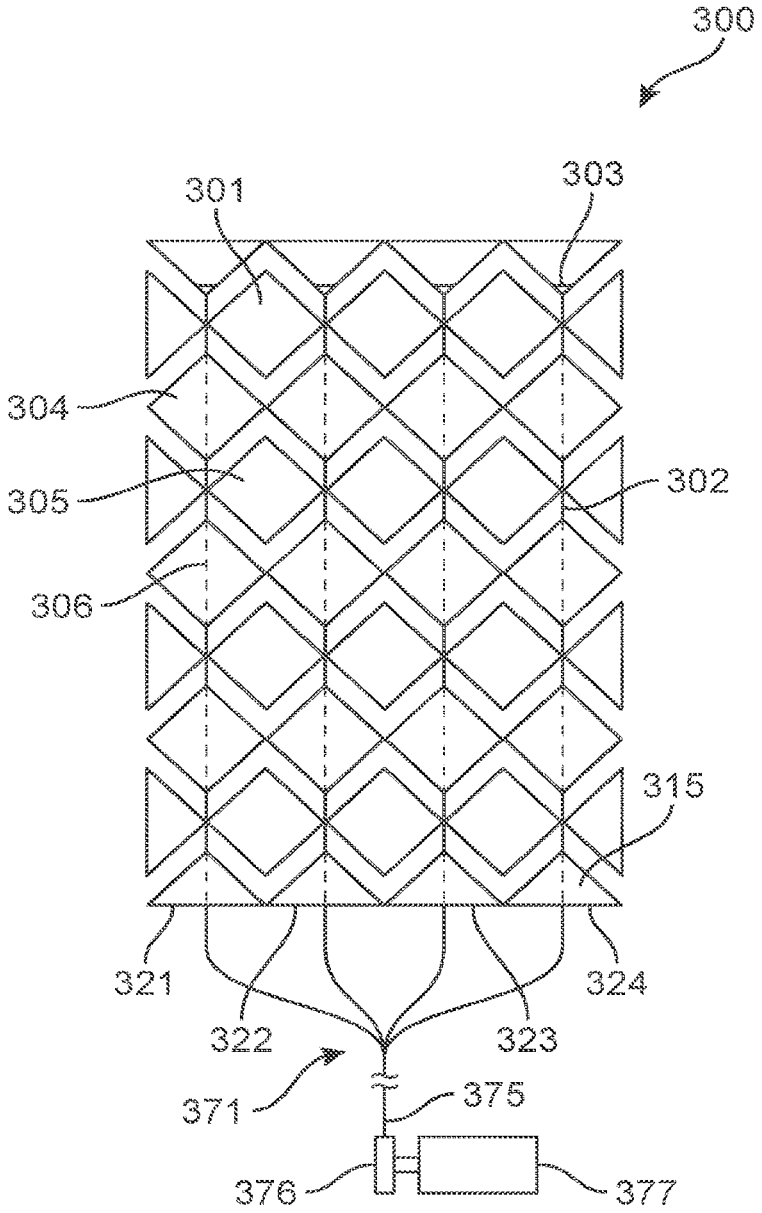
FIG. 11 shows an embodiment of the dynamic support system with cables extending in just one direction.

FIG. 11 illustrates an embodiment of the dynamic support system with cables extending only in the vertical direction. This dynamic support system 300 only uses vertical cables 302 inserted through alternate columns of tiles 301. The vertical cables are attached at one end to endpoints 303 and at the opposite end to a harness system, reel and motor (as shown in FIG. 2; not shown in FIG. 11) similar to the harness system, reel and motor shown in FIG. 2. Thus vertical cables 302 are only inserted through tiles 304 that have a passageway 306, in column of tiles 321, column of tiles 322, column of tiles 323 and column of tiles 324. Tiles 305 are not directly connected to vertical cables 302. The tiles in bottom row of triangular tiles 315 are fixed, such that the tiles above that row may be pulled against the tiles in row 315. Tiles 305 may or may not include a passageway, although such tiles would not have a cable traversing that passageway.

In the embodiment of FIG. 11, cables 302 are gathered in harness 371 to join end cable 375. End cable 375 is wound around reel 376. Reel 376 may be rotated in either direction by reversible motor 377 to compress or loosen the array of tiles.

Figure 12:
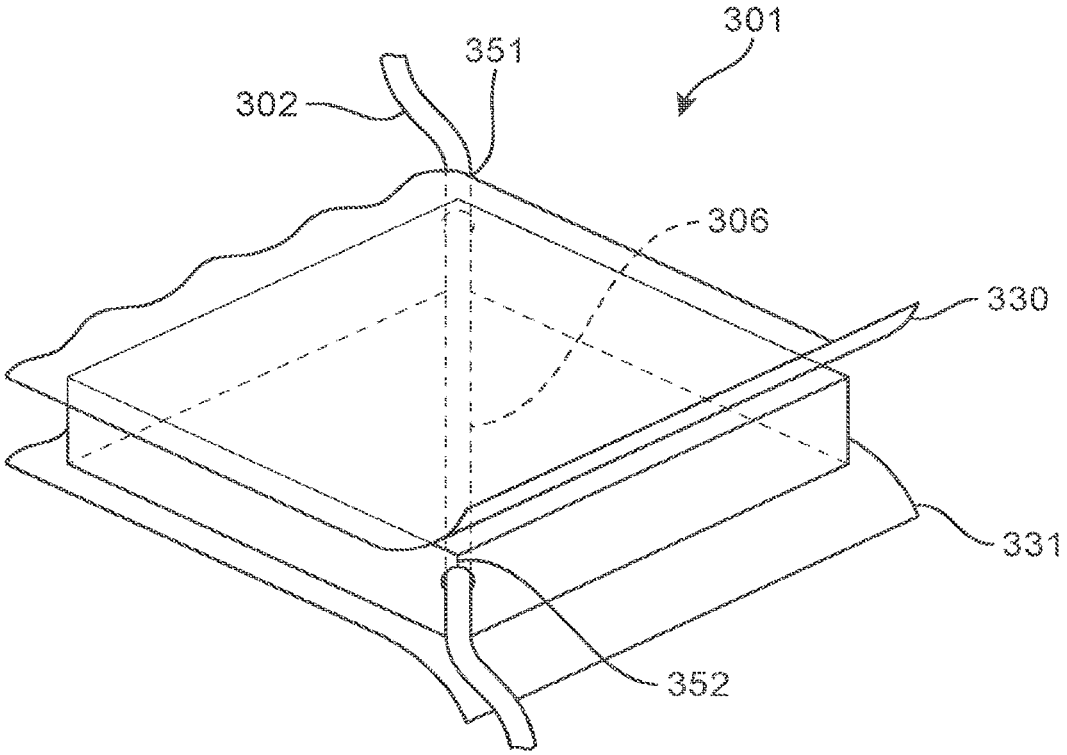
FIG. 12 is a schematic diagram showing an embodiment of a cable laced through a tile.

As shown in FIG. 12, tiles 301 have a cable 302 traversing a tile from corner 351 to corner 352 through passageway 306. In some embodiments, tiles 301 may be sandwiched between fabric layer 330 and fabric layer 331.

Figure 13:
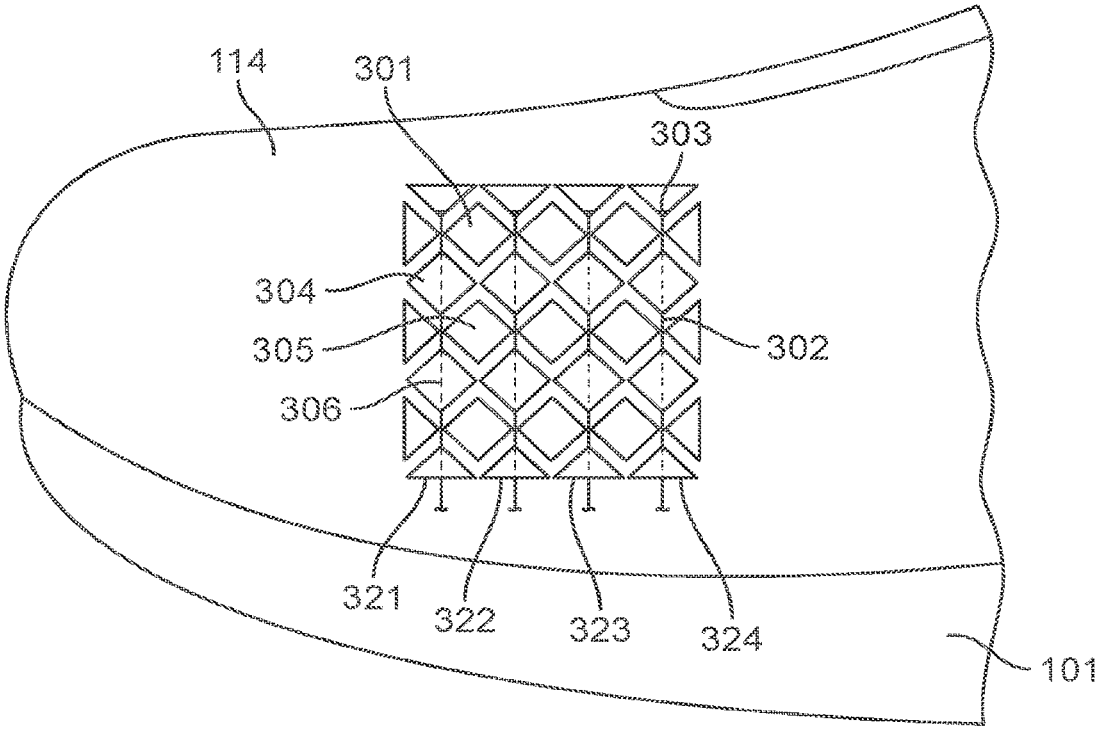
FIG. 13 shows the dynamic support system of FIG. 11 on the side of an upper in its initial state.
Figure 14:
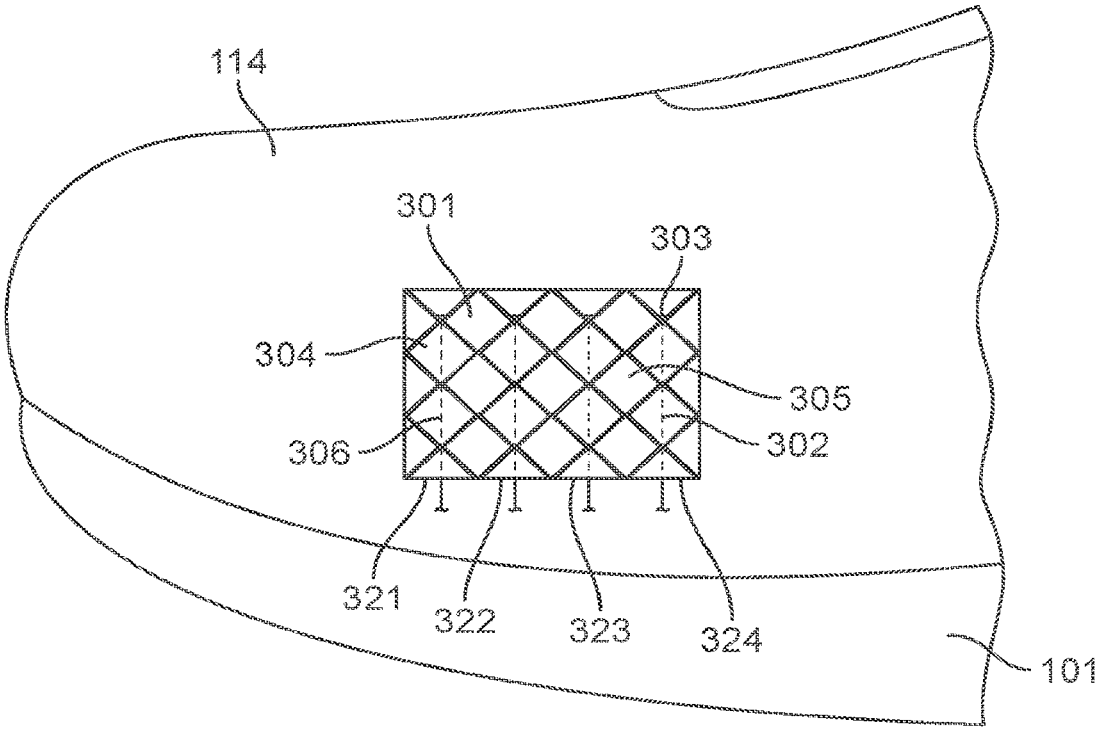
FIG. 14 shows the dynamic support system of FIG. 13 in its compressed state.

FIGS. 13 and 14 illustrate an example of how tiles 301 can be compressed to provide additional support and stability in the forefoot 114 of an article of footwear. FIG. 13 shows the dynamic support system of FIG. 11 in its relaxed state. Tiles 301 are arranged in an array across forefoot 114, with cables 302 extending laterally across forefoot 114 from endpoints 303 towards a harness system, a reel and a motor such as the harness system, reel and motor shown in FIG. 2. In this example, the reel and motor may be placed in the sole 101 of the forefoot 114. Tiles 304 in column of tiles 321, column of tiles 322, column of tiles 323 and column of tiles 324 have cables 302 passing through passageways 306 in tiles 304. As shown in FIGS. 13 and 14, tiles 305 are not attached to cables 302, and therefore can only move when they are pushed by tiles 304 that are attached to cables 302.

FIG. 14 illustrates the dynamic support system of FIG. 13 in its compressed state. Motor 377 and reel 376 (shown in FIG. 11) have been activated, pulling cables 302 laterally from endpoints 303 and pushing column of tiles 321, column of tiles 322, column of tiles 323 and column of tiles 324 laterally across forefoot 114. As the tiles 304 in column of tiles 321, column of tiles 322, column of tiles 323 and column of tiles 324 are pulled laterally across forefoot 114 so that they abut the triangular tiles in the bottom row (which are fixed), they push unattached tiles 305 laterally across forefoot 114 until the tiles in the array abut each other, as shown in FIG. 14. This results in a compact compressed array of tiles 301 that provides stability, support and protection at the forefoot 114 of the article of footwear.

Figure 15:
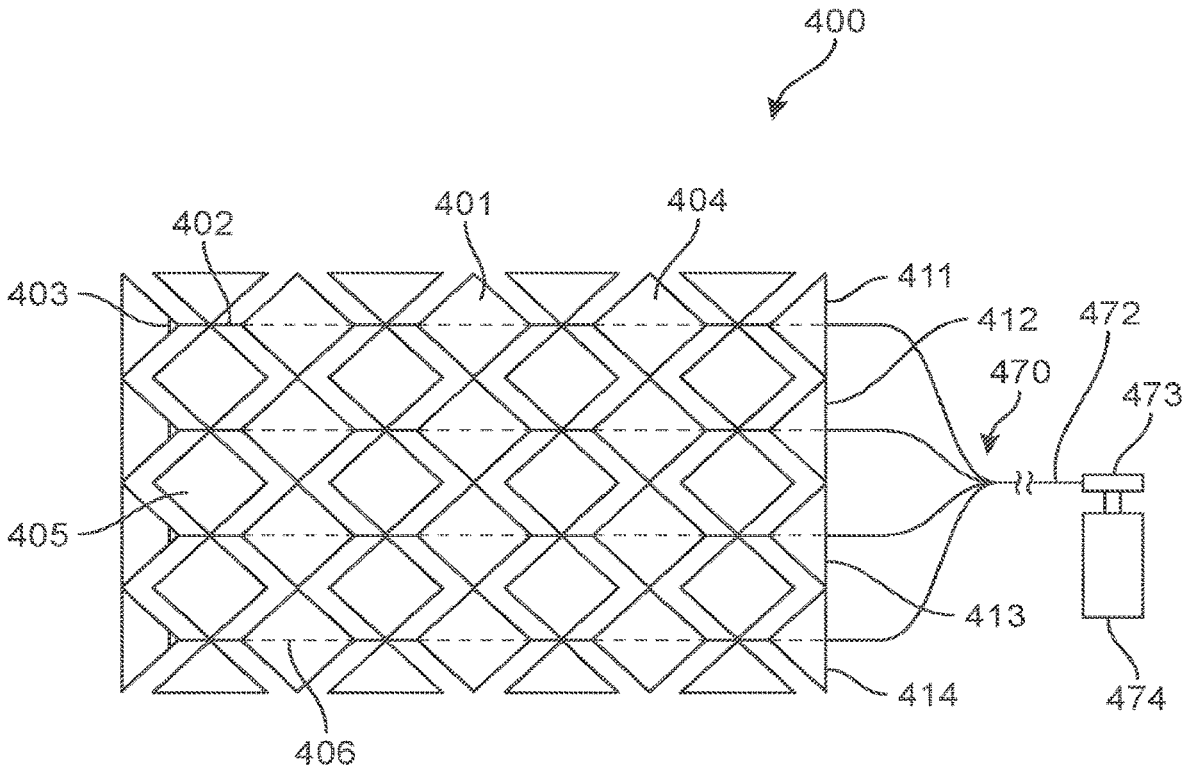
FIG. 15 shows an embodiment of the dynamic support system with cables extending horizontally.

FIG. 15 illustrates an embodiment of the dynamic support system with cables extending horizontally. In this embodiment, array 400 has cables 402 extending horizontally through passageways 406 in tiles 404. Tiles 405 are unattached. Row of tiles 411, row of tiles 412, row of tiles 413 and row of tiles 414 can be pulled laterally from endpoints 403, pushing unattached tiles 405 along, to produce a compressed array. Cables 402 are gathered to form harness 470, and are attached to end cable 472. End cable 472 is wound around reel 473. Reel 473 can be rotated in either direction by reversible motor 474.

Figure 16:
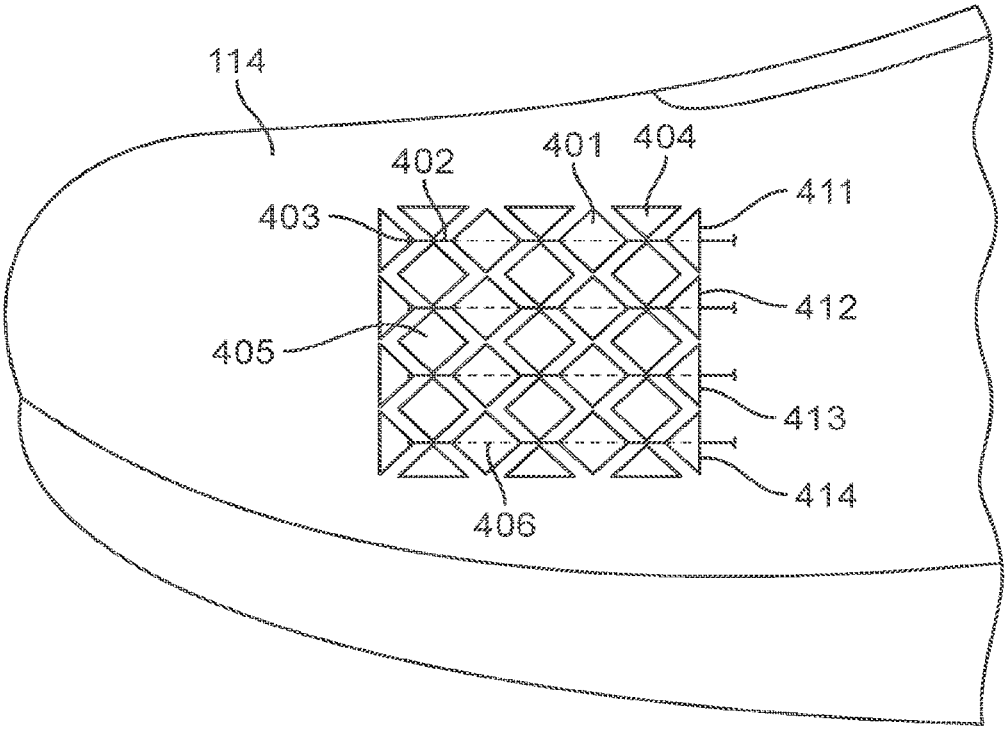
FIG. 16 shows how the array of tiles of FIG. 15 may be applied to the forefoot of an article of footwear.
Figure 17:
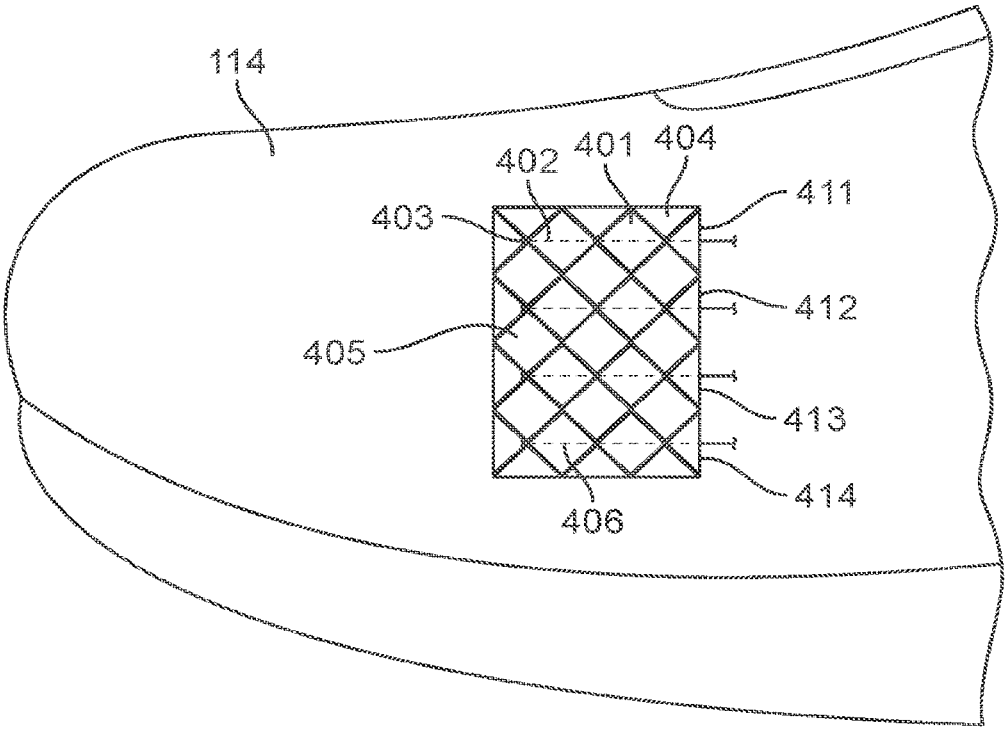
FIG. 17 shows the array of FIG. 16 in a compressed state.

FIGS. 16 and 17 illustrate an example of how the array 400 of tiles 401 shown in FIG. 15 may be applied to the forefoot 114 of an article of footwear. Row of tiles 411, row of tiles 412, row of tiles 413 and row of tiles 414 may be pulled longitudinally from their endpoints 403 by cables 402 by a harness, reel and motor system (not shown in FIGS. 16 and 17) contained in forefoot 114. When tiles 401 in row of tiles 411, row of tiles 412, row of tiles 413 and row of tiles 414 are pulled in so as to fully close the gaps between the tiles, the dynamic support system provides a maximum of protection, stability and support to forefoot portion 114, as shown in FIG. 17.

Figure 18:
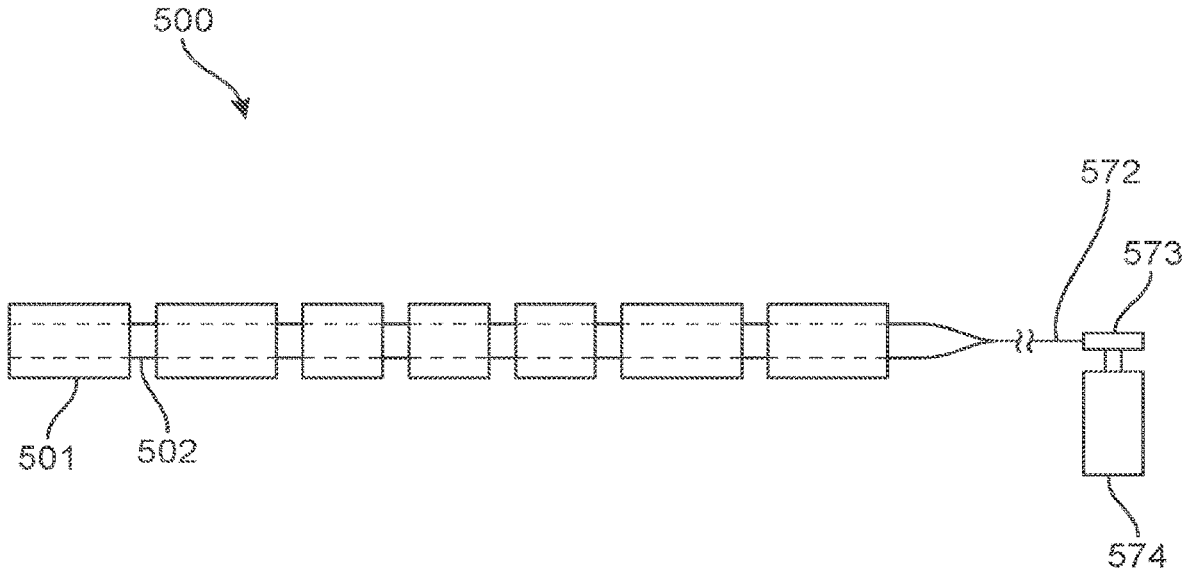
FIG. 18 is a schematic diagram of an embodiment of a dynamic support system with single row of tiles.
Figure 19:
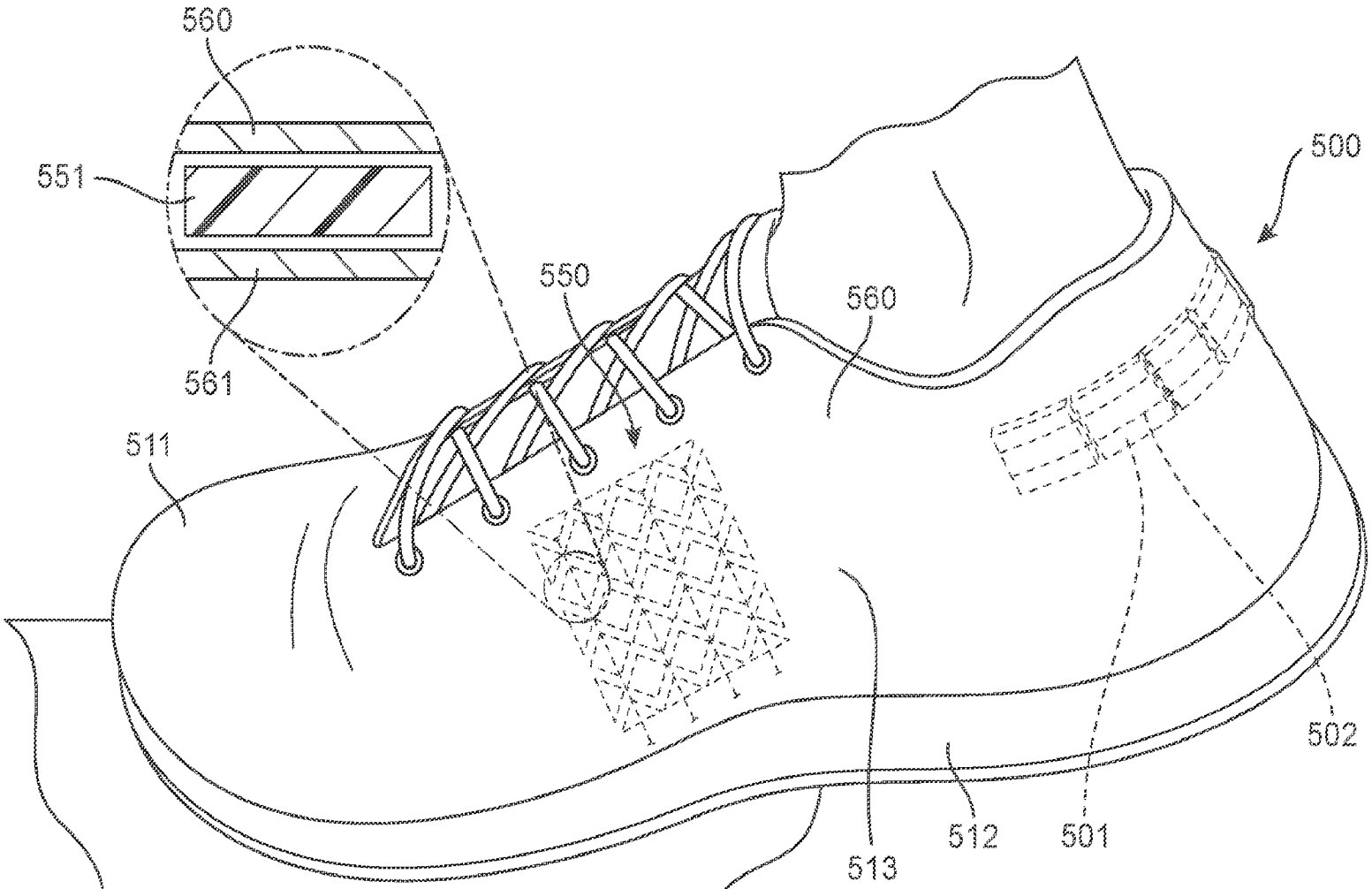
FIG. 19 shows the embodiment of FIG. 19 applied around the ankle opening of an upper.

FIGS. 18 and 19 illustrate an example of another embodiment of the dynamic support system, as it would be applied to the ankle opening of an upper. In this embodiment, the system has one row 500 of, for example, rectangular or square tiles, with a pair of cables 502 traversing the tiles 501 through their sides. In FIG. 18, the system is in its relaxed and flexible state, with the tiles 501 separated from each other. Cables 502 are attached to an end cable 572, which is wound around a reel 573, which can be rotated in either direction by a reversible motor 574.

FIG. 19 shows the array 500 deployed around the ankle opening 505 of an upper 511. Array 500 is shown in phantom in FIG. 19 as it is covered by the outer layer 560 of the fabric of upper 511. Note that, for clarity, the tiles are not shown in phantom in most of the figures in this specification. In most cases, the arrays of tiles are held between an outer layer and an inner layer. Typically, the outer layer protects the array of tiles from dirt, debris, moisture and other materials that might degrade the dynamic support system, and the inner layer provides a comfortable feel for the wearer's foot.

FIG. 19 shows array 500 in its compressed state as the heel of the shoe is bent upwards during a run or a jump. Tiles 501 have all been pulled together by reversible motor 574 pulling on end cable 572 and cables 502 to provide additional stability and support around the ankle and heel region of upper 505.

FIG. 19 also shows another array 550 of tiles 551 in the fabric on the side 513 of the upper. Again, this array is shown in phantom, because it is held between an outer layer 560 and an inner layer 561, as shown in the blow-up of a cross-section of the fabric shown in FIG. 19.

The preceding paragraphs and the figures described in those paragraphs describe the mechanical part of the dynamic support system, including the arrays of tiles, the cables, harnesses, the reels and the motors. The following paragraphs and figures describe the sensors which are used to detect certain actions and events and the algorithms used to control the motors which in turn control the configurations of the arrays of tiles.

In different embodiments, the locations of one or more sensors may vary. The sensors may be placed in various positions in the sole or in the upper, or may be worn by the wearer on his or her garments or on wrist bands, head bands, ankle wraps or knee pads, for example. The sensors may respond to pressure, tension, or acceleration.

Figure 20:
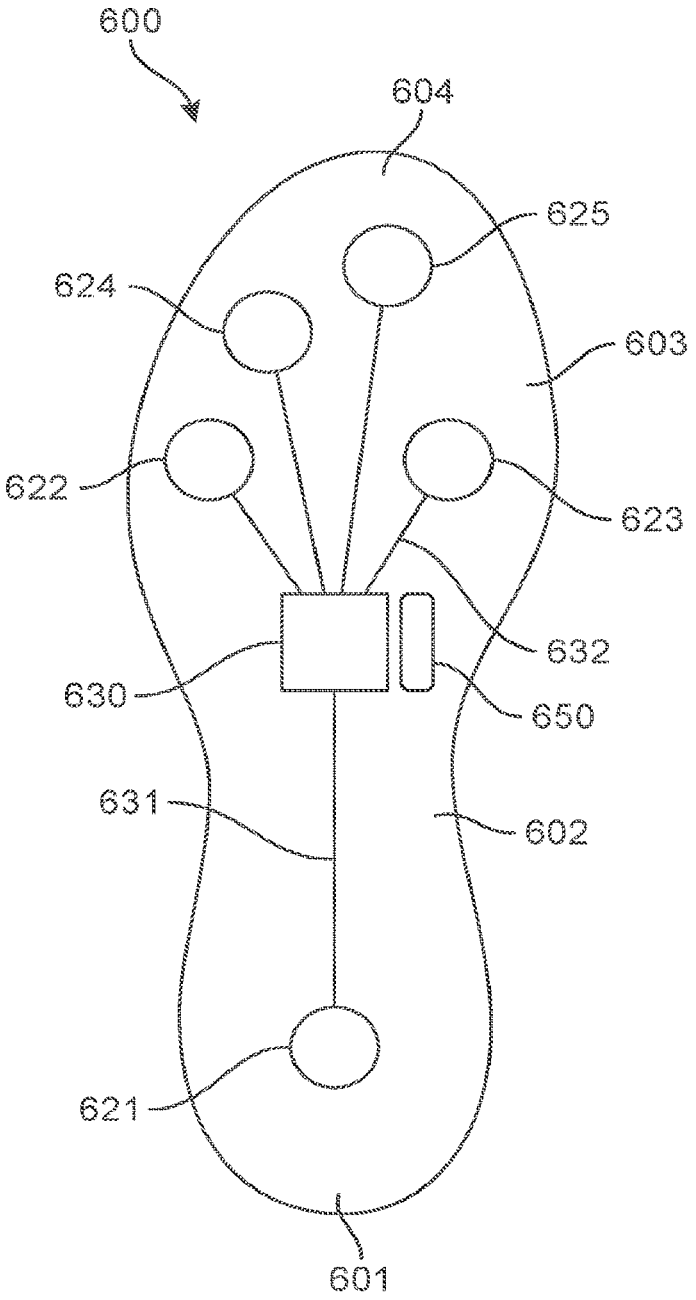
FIG. 20 illustrates an example of the placement of sensors in the sole of an article of footwear.

FIG. 20 is an example of the placement of pressure sensors in the midsole or outsole of the sole 600 of an article of footwear. The pressure sensors may be, for example, piezoelectric sensors or other sensors that detect pressure and provide an output signal representative of that pressure. In the example shown in FIG. 20, pressure sensor 625 is located under the wearer's big toe; pressure sensor 624 is located on the lateral side of the forefoot towards the front of forefoot 603 and pressure sensor 622 is located on the lateral side of the forefoot towards the rear of the forefoot; pressure sensor 623 is located on the medial side of the forefoot opposite to pressure sensor 622; and pressure sensor 621 is located in the heel 601 of sole 600. Each of the pressure sensors is in electrical communication via electrical wires with microprocessor 630. For example, as shown in FIG. 20, pressure sensor 625, pressure sensor 624, pressure sensor 623 and pressure sensor 622 are in wired communication with microprocessor 630 through the midfoot region 602 of sole 600 via wires 632. Sensor 621 is in wired communication with microprocessor 630 via electrical wires 631 through the midfoot region 602 of sole 600. In this example, microprocessor 630 is located in the midsole under the instep. The microprocessor could alternatively be located in other parts of the footwear such as elsewhere in the midsole or in the upper, in the outsole or at the back of the heel, for example. Also, instead of using wired communications, the sensors may communicate wirelessly with the microprocessor using a personal-area network based upon, for example, Advanced and Adaptive Network Technology, hereinafter ANT+ technology.

Microprocessor 630 and the motors it controls may be powered by a single battery, such as battery 650 shown in FIG. 20. However, in another embodiment, the article of footwear may have a separate battery for the microprocessor and another battery for all the motors. In still another embodiment, the article of footwear or may have a separate battery for the microprocessor and separate batteries for each of the motors or separate batteries for various combinations of motors.

When microprocessor 630 determines that pressure sensor 625 has detected a pressure exerted by the big toe against the sole that exceeds a predetermined threshold for pressure sensor 625, it may then activate a motor (such as motor 474 shown in FIG. 15) to compress the tiles in the toe region or in the forefoot region in order to fully support the wearer's foot as the wearer leaps or accelerates forward. Similarly, when microprocessor 630 determines that one or more of pressure sensor 622, pressure sensor 623, pressure sensor 624 and pressure sensor 621 has detected a pressure exerted against the sole that exceeds a predetermined pressure threshold for that specific sensor, it may activate motors to compress tiles in the region of the upper that are associated with that pressure sensor. An example of an algorithm that could be used with the sensor configuration shown in FIG. 20 is provided in FIG. 24, which is described below.

Figure 21:
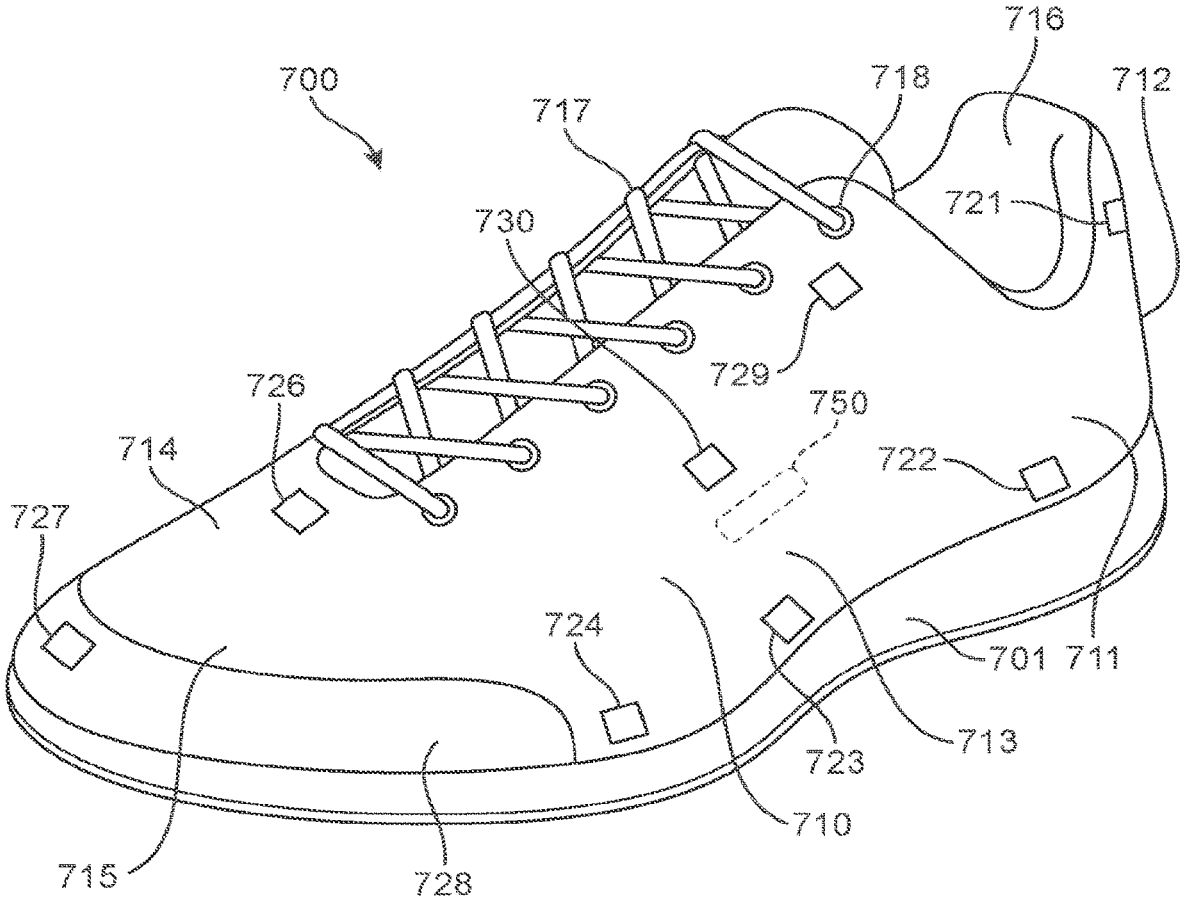
FIG. 21 illustrates an example of the placement of sensors in the upper of an article of footwear.

FIG. 21 is a schematic representation showing how sensors may be distributed in different locations of an upper 700 of an article of footwear. Thus sensor 721 may be located in the back of the heel region 712. Sensor 722 may be located in the lateral side of the heel region 711, with a complementary sensor (not shown) on the medial side of the heel region. Sensor 723 may be located in the lateral side of the midfoot region 710 near the sole, with a complementary sensor (not shown) in the medial side of the midfoot region near the sole. Sensor 729 may be located towards the top of the midfoot region 710, just below the laces on the lateral side, with a complementary sensor (not shown) in the medial side of the midfoot region just below the laces. Sensor 724 may be located towards the front of the forefoot region 714 near the sole, with a complementary sensor on the medial side of the forefoot region 714 near the sole. Sensor 726 may be located just in front of the shoe lace opening to detect, for example, the forefoot bending as the wearer pushes off from the toe region 715. Each of these sensors may be, for example, a strain gauge that measures the level of tension in the fabric of the upper.

Some embodiments may include various other kinds of sensors that detect, for example, contact (or impending contact with), an object such as a ball or another object. As an example, the embodiment of FIG. 21 may include a sensor 727 at a front of toe region 715. Sensor 727 may be, for example, an optical, infrared or acoustical proximity sensor. In some cases, it may be designed to detect impending impacts. For example, sensor 727 may be configured to detect impacts with a soccer ball, with a bench or other object on the sidelines of a playing field, or with an immovable object such as the wall of a squash court.

Microprocessor 730 is shown in FIG. 21 as located on the lateral side of the midfoot region of the upper, near battery 750. In some embodiments, the upper may have two microprocessors and two batteries, one set on the lateral side as show in FIG. 21, and one set on the medial side (not shown). Some embodiments may also have a third microprocessor and a third battery located, for example, in the back of the heel of the upper. In other embodiments, the microprocessors may be located elsewhere on the upper or in the sole. In the example shown in FIG. 21, the microprocessor(s) are in electrical communication with the sensors via electrical wires, which are not shown in FIG. 21. The microprocessors may continuously or sequentially monitor the stress levels reported by the sensors.

Battery 750 may be used to provide power to each of the motors that activate the cables that pull the tiles together. Alternatively, separate batteries may be used for the microprocessor and for the motors. For example, each microprocessor could have its own battery and each motor could have its own battery.

Figure 22:
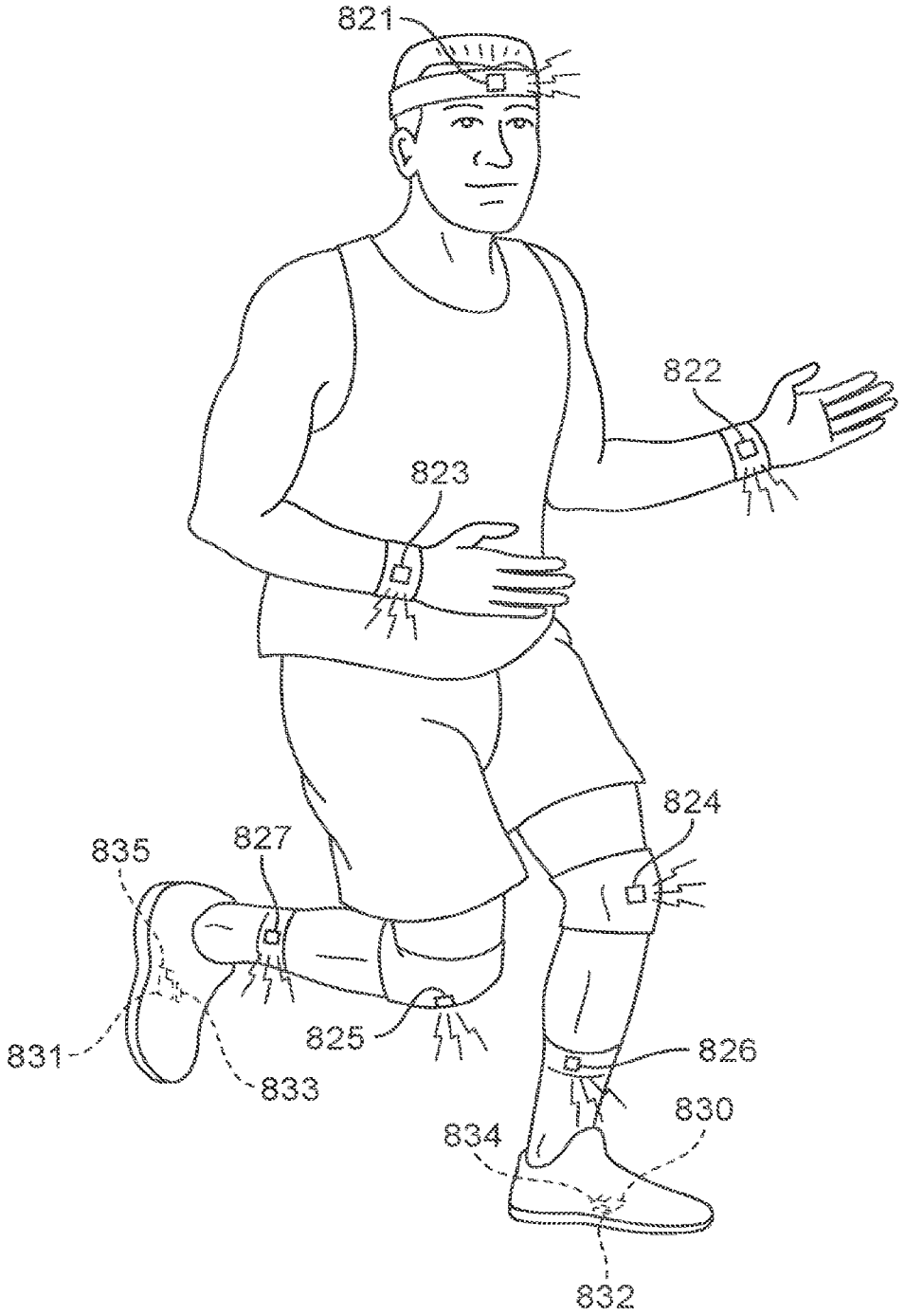
FIG. 22 illustrates an example of the placement of sensors in articles worn by a wearer of an article of footwear.

FIG. 22 is a schematic representation of an example of an athlete wearing sensors in various parts of his body. In the example illustrated in FIG. 22, the athlete has a sensor 821 on his headband, a sensor 822 on his left wrist, a sensor 823 on his right wrist, a sensor 824 on a knee pad on his left knee, a sensor 825 on a knee pad on his right knee, a sensor 826 on a wrap around his left ankle and a sensor 827 on a wrap around his right ankle. These sensors may be, for example, accelerometers that can detect motion and/or direction. Each of these sensors includes a battery, and wirelessly communicates with microprocessor 830 via antenna 834 and microprocessor 831 via antenna 835 in the athlete's shoes. The sensors may communicate with microprocessor 830 over a personal-area network (PAN) using, for example, the ANT+ wireless technology. In the example shown in FIG. 22, microprocessor 830 is powered by battery 832, and microprocessor 831 is powered by battery 833.

In addition, these sensors may communicate with microprocessors (not shown) that control other systems or devices in the articles worn by the athlete. For example, the sensors may be used to activate dynamic support systems (not shown) that are associated with a knee pad, head band, wrist band, or ankle wrap, in addition to communicating with microprocessors in the footwear. Thus, for example, sensor 824 may detect information used to tighten a dynamic support system (not shown) within the associated knee pad.

Figure 23:
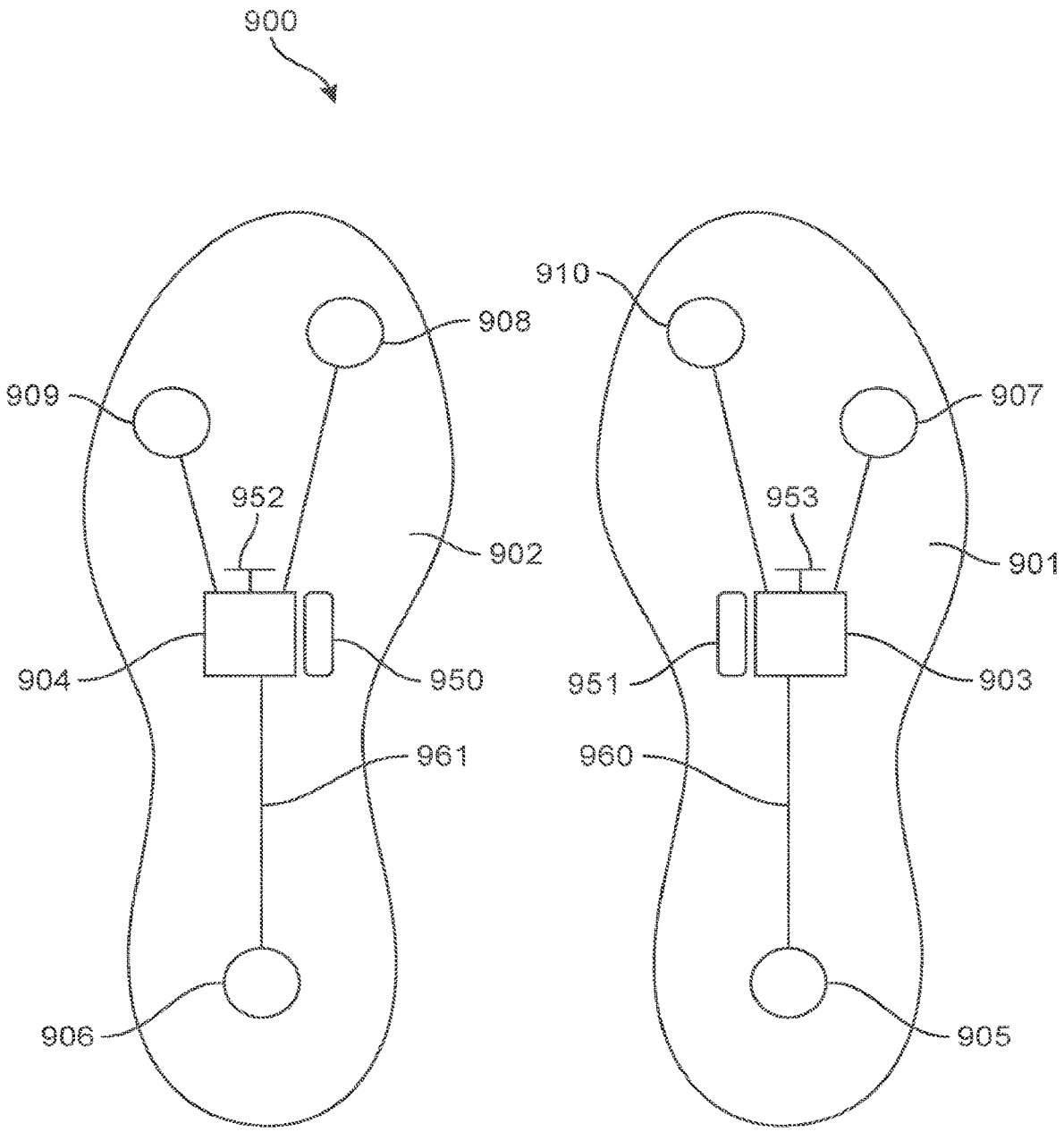
FIG. 23 illustrates an example of the placement of sensors in the soles of a pair of articles of footwear.

FIG. 23 is a schematic illustration of the sole 901 and sole 902 of a pair of footwear, as viewed from the bottom. Left sole 901 has sensor 910 in the big toe region, sensor 907 on the lateral side of the forefoot region and sensor 905 in the heel region. Right sole 902 has sensor 908 in the big toe region, sensor 909 on the lateral side of the forefoot region and sensor 906 in the heel region. Left sole 901 also has microprocessor 903 in its midfoot region. Right sole 902 has microprocessor 904 in its midfoot region. Each of these sensors may be, for example, a piezoelectric sensor.

Microprocessor 903 is powered by battery 951. It has an associated antenna 953. Microprocessor 904 is powered by battery 950. It has an associated antenna 952. Microprocessor 903 and microprocessor 904 can communicate with each other wirelessly using, for example, ANT+ wireless technology, via antenna 952 and antenna 953. In this example, sensor 910, sensor 907 and sensor 905 are in electrical communication with microprocessor 903 via electrical wires 960 and sensor 908, and sensor 909 and sensor 906 are in electrical communication with microprocessor 904 via electrical wires 961.

FIGS. 24-28 illustrate exemplary processes for controlling a dynamic support system. These processes may be utilized with articles that include two or more independently controlled arrays of tiles for providing support over multiple regions an article. An example of one such article is the article depicted in FIG. 19, which includes an array 500 for dynamic support of the heel and array 550 for dynamic support on the side of the article. Thus, these processes provide exemplary processes for providing targeted dynamic support according to information received from one or more sensors distributed across the article.

Figure 24:
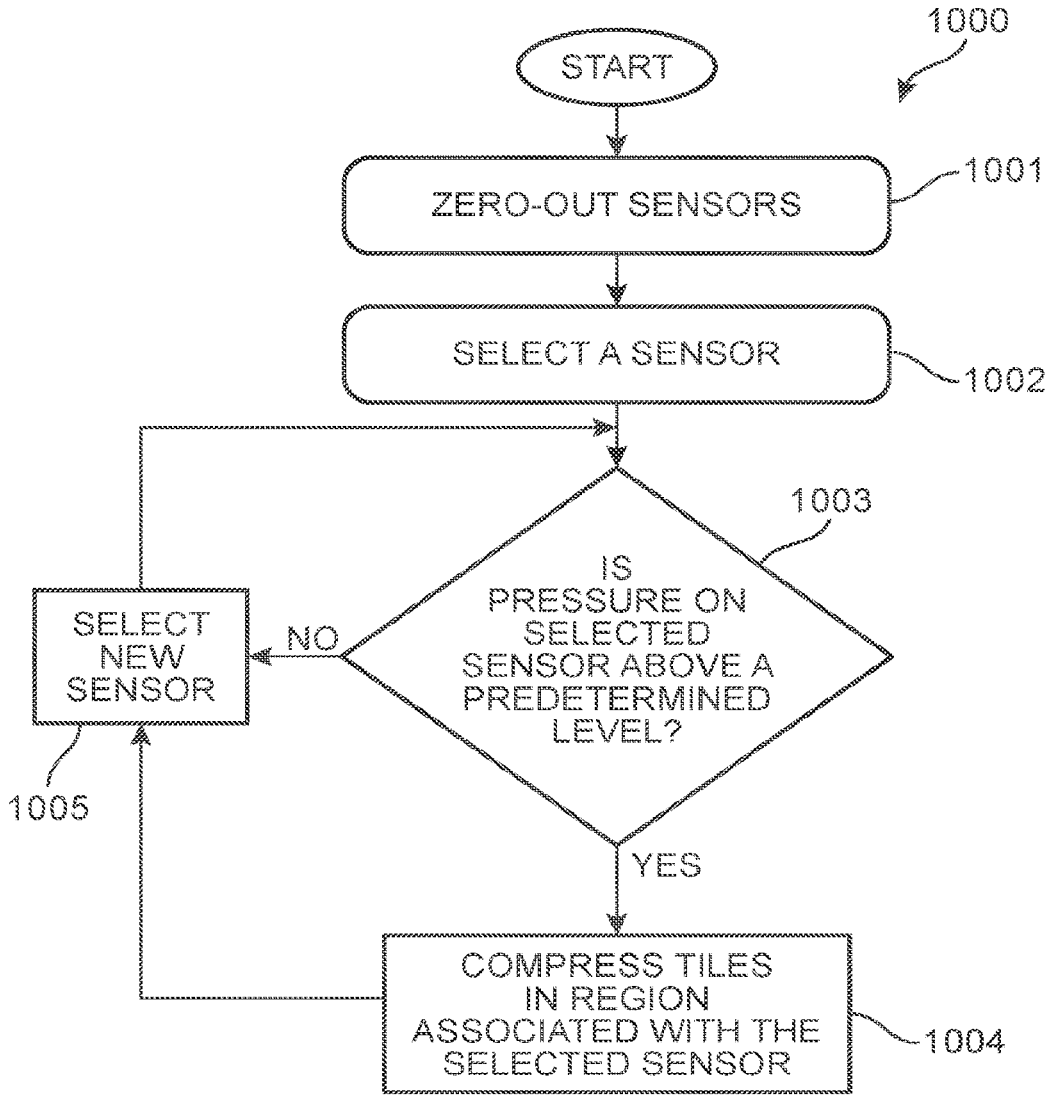
FIG. 24 is an example of an algorithm that may be used to implement the dynamic support system.

FIG. 24 is an example of an algorithm that may be used by the footwear shown in FIG. 20. In some embodiments, the following steps may be accomplished by a microprocessor associated with a dynamic support system. However, in other embodiments, some steps may be accomplished by other systems or devices. Moreover, in other embodiments, some of the following steps could be optional.

Once the microprocessor has been activated by turning it on or by inserting a battery, the wearer may set the sensors to zero by standing flat-footed on the playing surface for a predetermined time, for example three to five seconds. This is shown as step 1001 in the algorithm of FIG. 24. In step 1002, the microprocessor may select a sensor. In situations where an article includes multiple sensors for detecting pressures or forces over multiple different regions of the article, the microprocessor may select one of the sensors to check according to some predetermined sequence or as determined by other parameters.

In this example, the selected sensor could be sensor 625 shown in FIG. 20, and the region associated with the selected sensor could be the toe region of the upper. Other sensors may be associated with other regions of the upper, such as the forefoot region of the upper, the lateral side of the forefoot region of the upper, the medial side of the forefoot region of the upper, the lateral side of the midfoot region of the upper, the medial side of the midfoot region of the upper, the lateral side of the heel region of the upper, the medial side of the heel region of the upper, the region around the laces or the region around the ankle opening of the upper, or any other region of the upper that could benefit from dynamic control of its supportive characteristics.

Next, in step 1003, the microprocessor determines if the pressure recorded by the sensor is above a predetermined level. In some cases, the predetermined level of pressure may be pre-programmed into the microprocessor, while in other cases the predetermined level could be determined by previously sensed information.

If the reported pressure is above the predetermined level (e.g., above the threshold pressure), in step 1004 the microprocessor activates the motor controlling the tiles in a region associated with the selected sensor to compress the tiles in that region.

If the pressure on the selected sensor was not above the predetermined level in step 1003, the microprocessor proceeds to step 1005 to select a new sensor. At this point, the microprocessor returns to step 1003 to determine whether the pressure reading at the new sensor is above a predetermined level. Thus, it may be seen that the microprocessor can cycle through checking different sensors to determine if dynamic support (in the form of compressing an array of tiles) should be provided at a region associated with the sensor. Likewise, after step 1004, during which compression of tiles is applied at a specific region of the article, the microprocessor may proceed to step 1005 to select a new sensor and repeat the process.

Thus, this exemplary process depicts a situation where a single microprocessor cycles through checks of various sensors in the article to determine if one or more regions should be supported via compression of tiles. However, it should be understood that in other embodiments two or more microprocessors can be configured to simultaneously check on the status of at least two different sensors, rather that utilizing a single microprocessor to check the status of each sensor in sequence.

Figure 25:
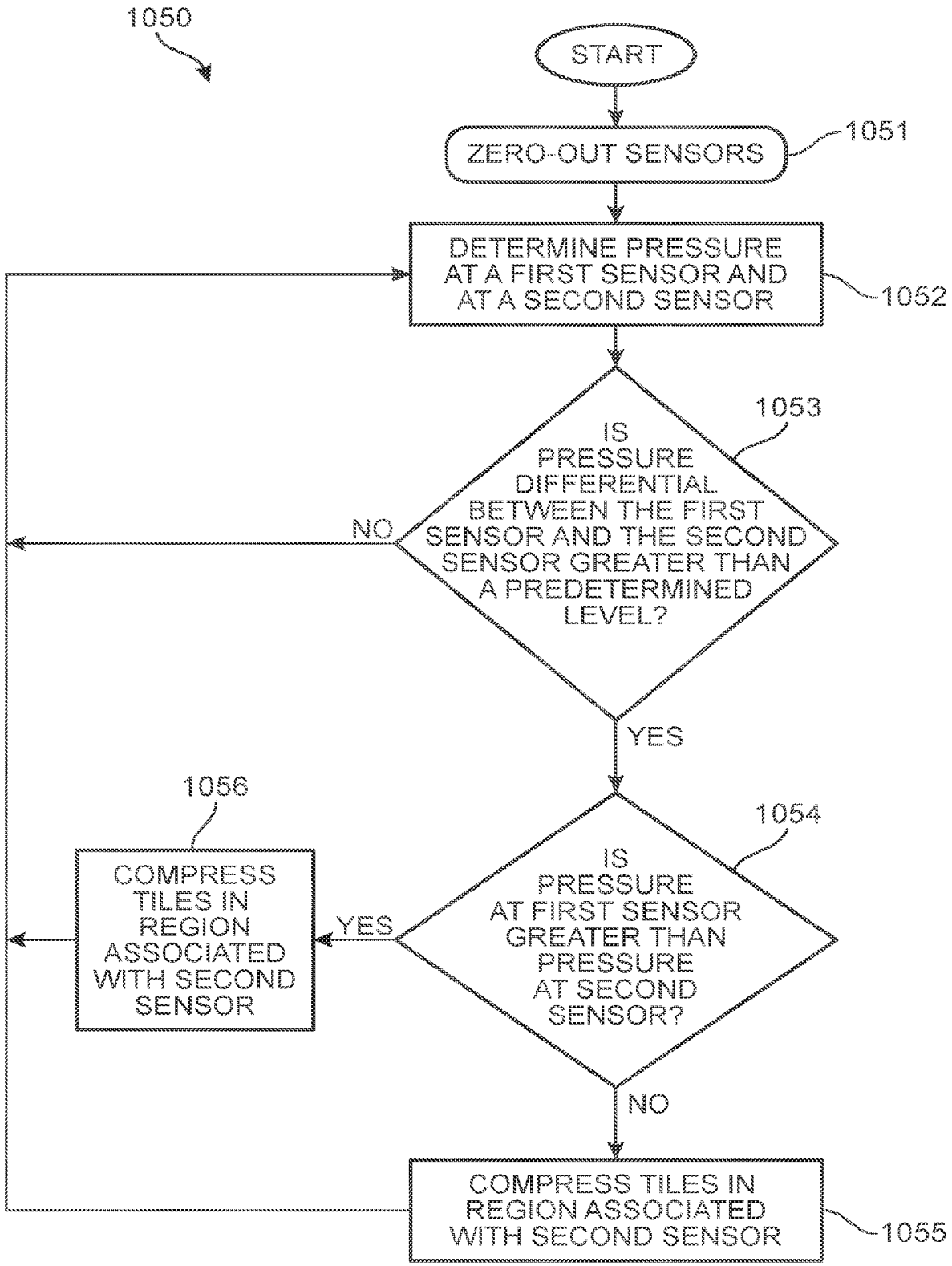
FIG. 25 is an example of another algorithm that may be used to implement the dynamic support system.

FIG. 25 illustrates another exemplary process that may be used for controlling a dynamic support system that may also be used with the embodiment of FIG. 20. Once the microprocessor has been activated by turning it on or by inserting a battery, the wearer may set the sensors to zero by standing flat-footed on the playing surface for a predetermined time, for example three to five seconds. This is shown as step 1051 in the algorithm of FIG. 25.

In step 1052, the microprocessor determines the pressure at a first sensor and simultaneously determines the pressure at a second sensor that is different from the first sensor. As an example, the first sensor could be associated with the lateral side of the article while the second sensor could be associated with the medial side of the article. Next, in step 1053, the microprocessor determines if there is a pressure differential between the first sensor and the second sensor. In particular, the microprocessor may determine if the differential is above a predetermined level. If so, the microprocessor proceeds to step 1054. Otherwise, the microprocessor may proceed back to step 1052 to determine the pressures at the two sensors again, or possibly at a different pair of sensors.

At step 1054, the microprocessor determines if the pressure at the first sensor is greater than the pressure at the second sensor. If so, the microprocessor proceeds to step 1056 to compress tiles in the region associated with the first sensor. Otherwise, the microprocessor proceeds to step 1055 to compress tiles in the region associated with the second sensor. Thus, if at step 1054 the microprocessor determines that the pressure detected at the lateral side of the foot (detected by the first sensor) is greater than the pressure detected at the medial side of the foot (detected by the second sensor), then the microprocessor controls the array of tiles on the lateral side of the foot to compress. Such an action may increase support on the lateral side of the foot as the user applies makes cutting moves in the lateral direction.

Although not shown in the exemplary processes, some embodiments could include steps of determining if all the sensors of an article report negative pressures, which would indicate pressures below the zero levels set at the beginning of operation (e.g., in step 1001 of FIG. 24). Depending on the sport or other activity the footwear is intended for, this might indicate that the footwear is completely off the ground. In that case, the microprocessor—possibly after a predetermined delay-could compress the tiles in a specific region in anticipation of a hard landing on that particular foot. A delay from when the microprocessor first determined that the footwear is off the ground to when it activates compression could be tailored to the specific wearer of the shoe and to his or her particular style.

Microprocessor 630 may execute several algorithms such as the algorithms shown in FIGS. 24 and 25 simultaneously. Different algorithms may be used to control the characteristics of the upper in different regions of the upper, for example, or the same algorithm could be used with different sets of sensors to control different regions of the upper.

Figure 26:
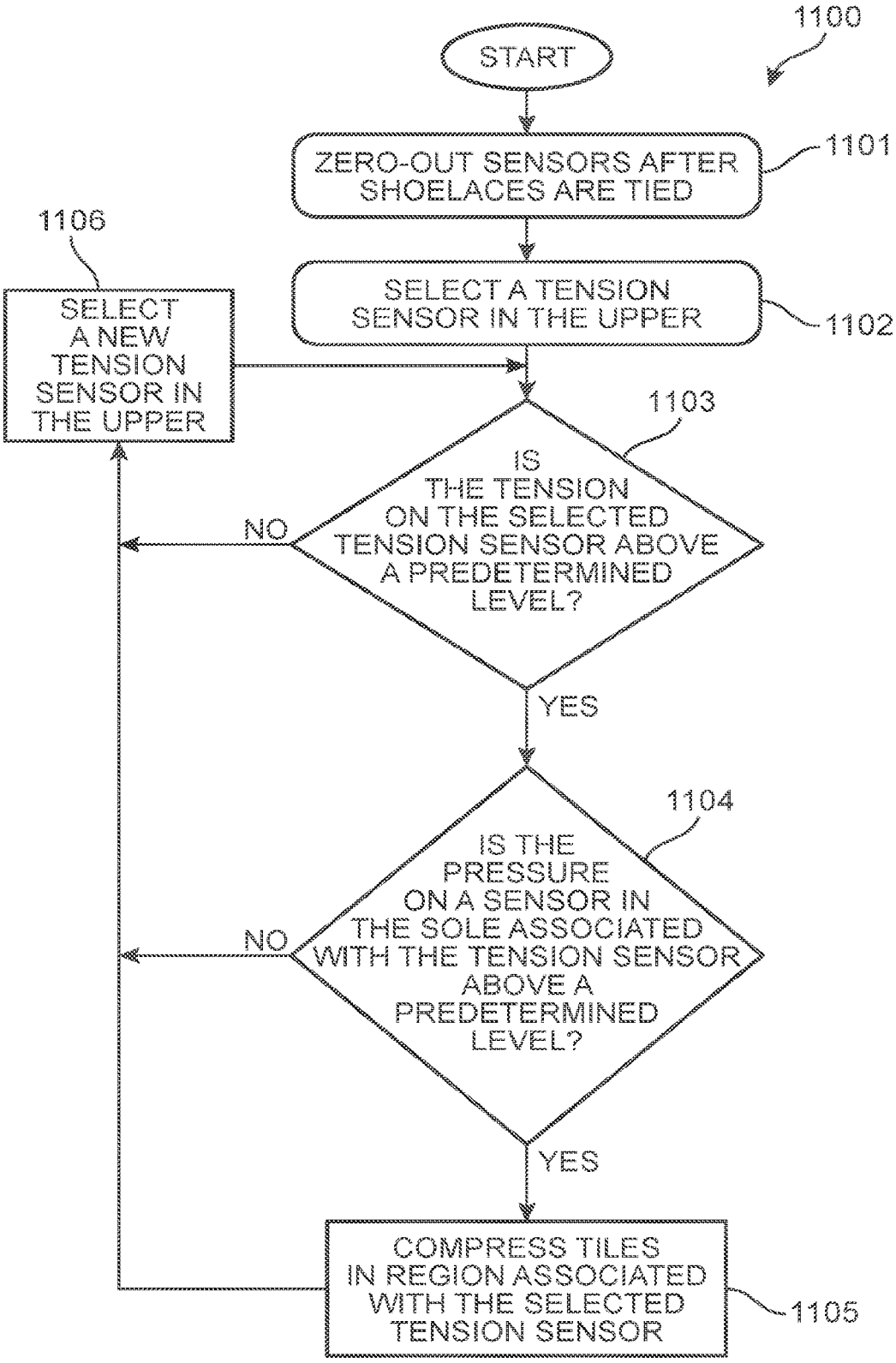
FIG. 26 is an example of another algorithm that may be used to implement the dynamic support system.

FIG. 26 is an example of an algorithm that may be used with the tension sensors in the upper shown in FIG. 21 as well as the pressure sensors on the sole shown in FIG. 20. In this example, the tiles in a given region of the upper are only compressed if both a tension sensor in the upper and a pressure sensor in the sole associated with that tension sensor report stress levels above predetermined levels. Thus at step 1101, the sensors are zeroed-out after the shoelaces have been tied by, for example, standing on the playing surface for a period of three to five seconds. Next, in step 1102, the microprocessor selects a tension sensor from among the tension sensors in the upper, such as sensor 721, sensor 722, sensor 723, sensor 724, sensor 726 and sensor 729 shown in FIG. 21. In step 1103, the microprocessor determines if the tension on the selected tension sensor is above a predetermined level for that sensor. If it is not above the predetermined level for that sensor, the microprocessor goes on to step 1106, where it selects a new tension sensor in the upper.

If the tension on the selected tension sensor is above the predetermined level for that sensor, the microprocessor goes on to step 1104, where it checks whether the pressure reported by a sensor in the sole that is associated with the selected tension sensor is above a predetermined level for that pressure sensor. For example, if the selected tension sensor is sensor 724 shown in FIG. 21 on the lateral side of the forefoot, the pressure sensor in the sole may be sensor 624 shown in FIG. 20 on the lateral side of the sole. If the pressure reported by the pressure sensor in the sole is above a predetermined level for that sensor, then in step 1105 the microprocessor activates a motor to compress tiles in a region associated with the tension sensor in the upper. For example, if the selected tension sensor was sensor 724 shown in FIG. 21, then the region associated with the selected tension sensor may be the lateral forefoot region of the upper.

If the pressure in the associated pressure sensor is not above the predetermined level for that sensor, then the microprocessor goes on to step 1106, where it can select a new tension sensor, and continue with the algorithm.

An algorithm such as the one shown in FIG. 26 could be used, for example, for a runner running over a mountain trail, who would only need the increased support when both a tension sensor in the upper and a pressure sensor in the sole report high stress levels. These might indicate, for example, that the runner may need increased support because she is stepping on the side of a rock. In that case, tiles in the upper would need to be compressed to provide additional support.

In some embodiments, for certain tension sensors in the upper, the algorithm may not need to check with an associated pressure sensor in the sole. For those tension sensors, their associated region in the upper may be compressed without checking whether the pressure reported by an associated pressure sensor is above a predetermined level. Those tension sensors would then report to an algorithm that would only include steps such as step 1101, step 1102, step 1103, step 1105 and step 1106 in FIG. 26—step 1104 would be omitted.

Figure 27:
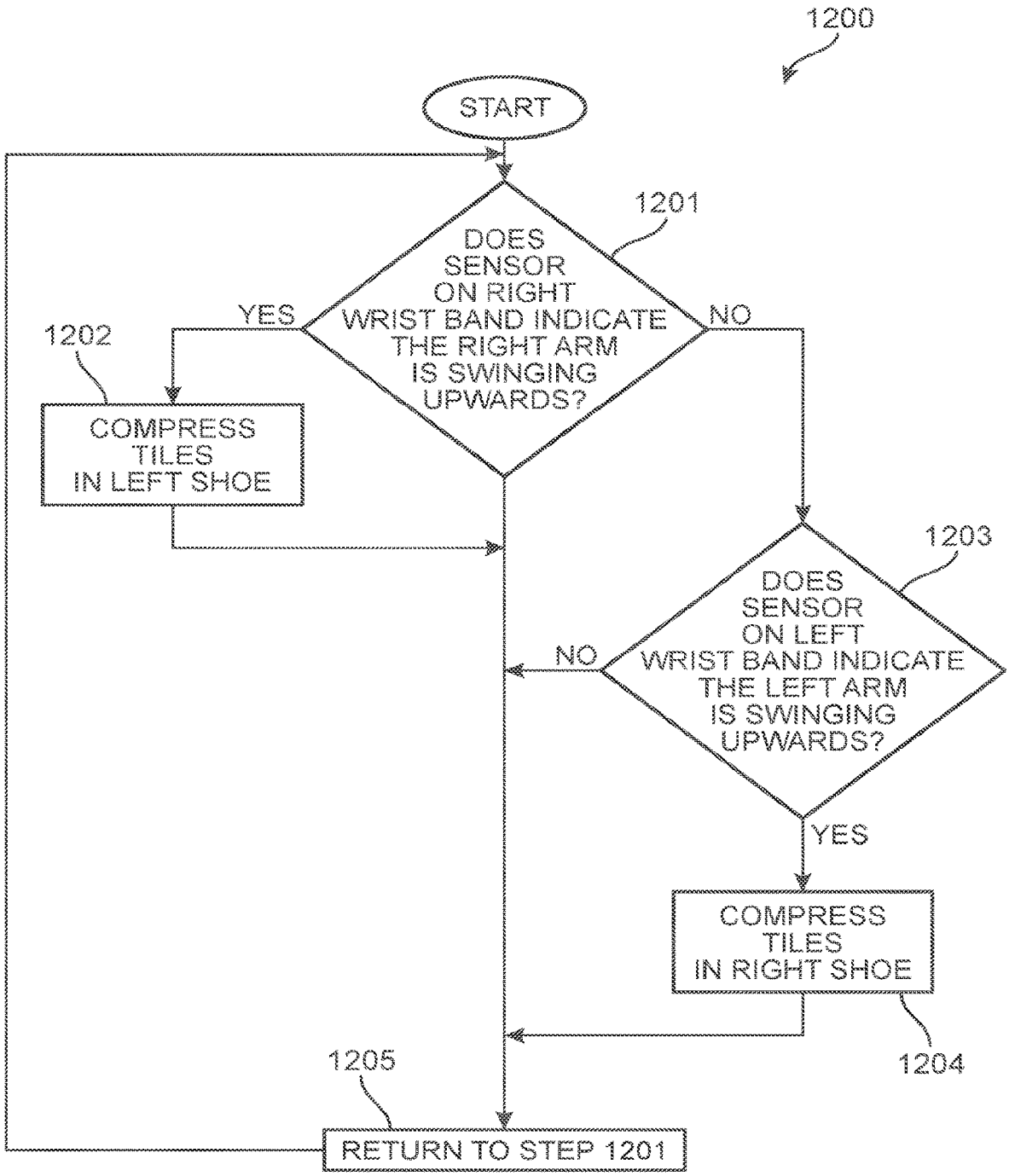
FIG. 27 is an example of another algorithm that may be used to implement the dynamic support system.

FIG. 27 is an example of an algorithm that may be used with the system shown in FIG. 22. This algorithm allows a runner, for example, to maintain flexibility in the upper when he or she is running lightly, but then have increased support when he or she is running hard or running downhill, for example. In step 1201, the microprocessor determines whether a motion sensor such as motion sensor 822 on the right wrist band in FIG. 22 indicates that the wearer's right arm is swinging upwards, which could indicate that the runner is running hard and is pushing off or will be pushing off his or her left foot. If the answer is yes, in step 1202 the microprocessor in the left shoe activates to compress tiles on the lateral side of the footwear. If the answer is no, the microprocessor in step 1203 determines whether the sensor on the left wrist band indicates that the left arm is swinging upwards, which could indicate that the runner is running hard and is pushing off or will be pushing off his or her right foot. If the answer is yes, the microprocessor in the right shoe activates a motor to compress tiles in the right shoe. If the answer is no, or after executing step 1204 and/or step 1202, the microprocessor returns to step 1201 in step 1205.

Thus the algorithm of FIG. 27 may anticipate increased stress in the forefoot of a runner whose arm starts the upward swing before the full pressure is exerted on the sole of the forefoot when the runner is pushing off to extend his or her stride. Because the stress in the footwear is anticipated, the tiles can be compressed in time to provide optimal support at the optimal time.

Figure 28:
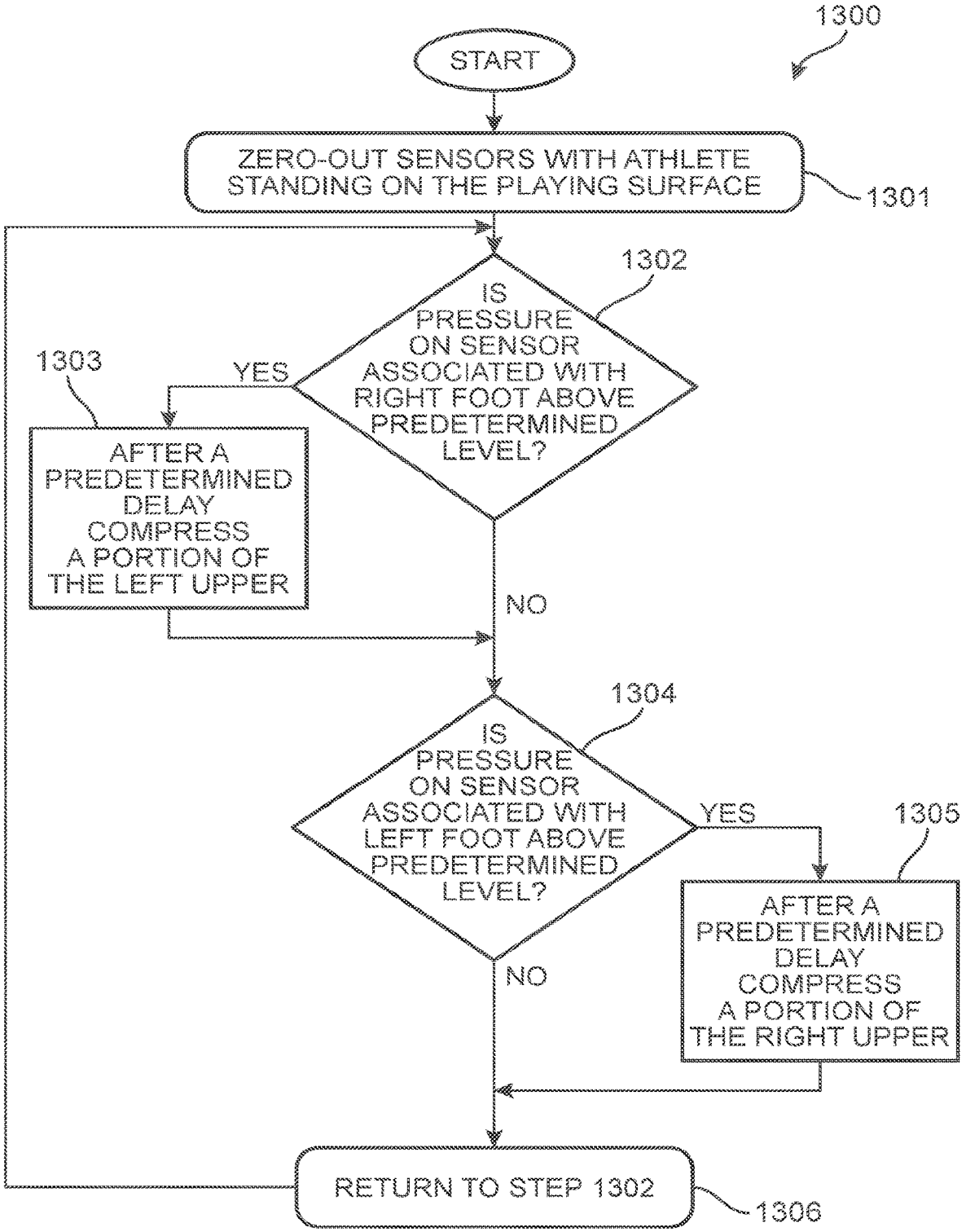
FIG. 28 is an example of another algorithm that may be used to implement the dynamic support system.

FIG. 28 is an example of an algorithm that could be used with the two-sole embodiment shown in FIG. 23. This embodiment uses two microprocessors, one in the left sole and one in the right sole working together to execute the algorithm. The algorithm depends on wireless communication between, for example microprocessors such as microprocessor 903 in sole 901 and microprocessor 904 in sole 902 to provide optimum stability to the footwear when needed. In this embodiment, pressure detected by sensors in, for example, the left sole is used to predict stresses that will occur after a time interval in the right upper, and thus to compress tiles in the appropriate region of the right upper. For example, if a sensor such as sensor 910 in the right sole detects increased pressure on the right sole (indicating that the wearer is pushing off on his or her right foot), it is likely that after a time interval the left foot will experience increased pressure (as the wearer lands on his or her left foot). The dynamic support system anticipates this result, and prepares for the result by increasing the support in the left foot after a time delay. The time delay may be adjustable for the individual user.

Thus in step 1301, the sensors in both soles are zeroed-out with the athlete or recreational wearer standing on the playing surface or on the ground. In step 1302, if a microprocessor such as microprocessor 904 in the right sole determines that the pressure detected by a sensor such as sensor 909 in FIG. 23 in the right sole is above a predetermined threshold, then it wirelessly provides this information to a microprocessor such as microprocessor 903 in the left sole. After a predetermined time interval, the microprocessor in the left sole then activates a motor to compress tiles in a portion of the left upper. If in step 1302, the microprocessor in the right sole determines that the pressure on a sensor in the right sole is not above the predetermined level or after step 1303, the microprocessor passes control to the microprocessor in the left sole. In step 1304, the microprocessor in the left sole determines if the pressure on a corresponding sensor in the left sole is above a predetermined level. If this pressure is above the predetermined level, then after a predetermined delay, the microprocessor in the right sole activates a motor to compress tiles in a portion of the right upper. After step 1304 or after step 1305, in step 1306 the algorithm returns to step 1302 and starts over.

As noted above, the delays in compressing regions in the left or right uppers may be adjustable to suit the activity engaged in or to suit the characteristics of the wearer. For example, one runner may need only a short time delay because that runner may take many relatively short strides while a second runner may need a longer delay because the second runner may take longer strides. In some embodiments, the algorithm may be self-adjusting—the time delay between the pressure detected in the left sole and the impact of the right sole may be measured and used to optimize the time delay in steps 1303 and 1305 during subsequent strides.

Figure 29:
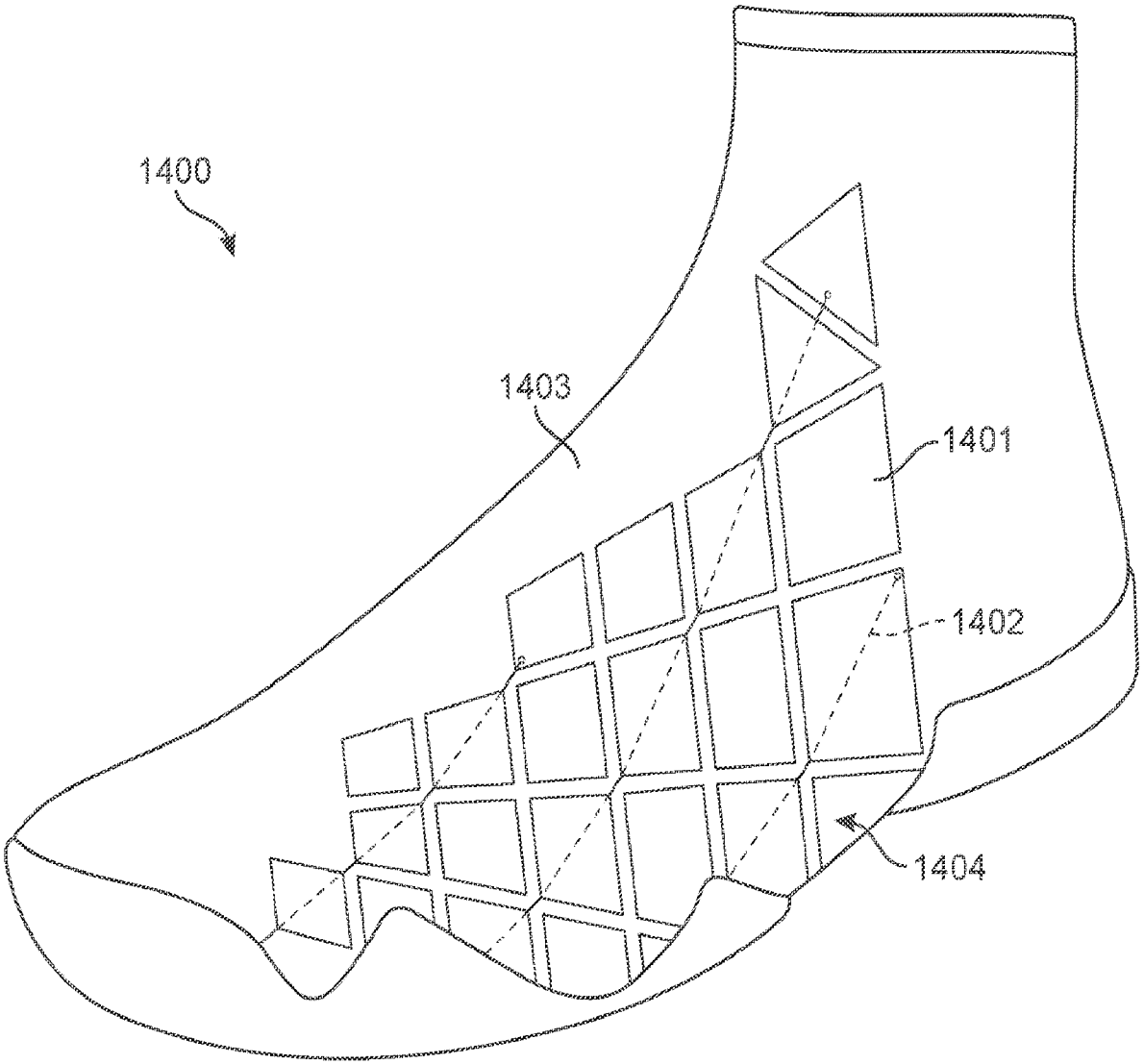
FIG. 29 is a schematic diagram of an embodiment of the dynamic support system applied to a basketball shoe.

FIGS. 29-36 illustrate various embodiments as they might be used in specific athletic or recreational activities. For example. FIG. 29 illustrates an article of footwear that could be used for playing basketball. In FIG. 29, article of footwear 1400 is in its relaxed state. Article of footwear 1400 has an array of tiles 1401 on the lateral side 1403 of footwear 1400. Cables 1402, shown in phantom in FIG. 28, connect tiles 1401 in array 1404 to reels and motors in the sole. Because article of footwear 1400 is in its relaxed state, tiles 1401 are spaced apart from each other and cables 1402 are extended.

Figure 30:
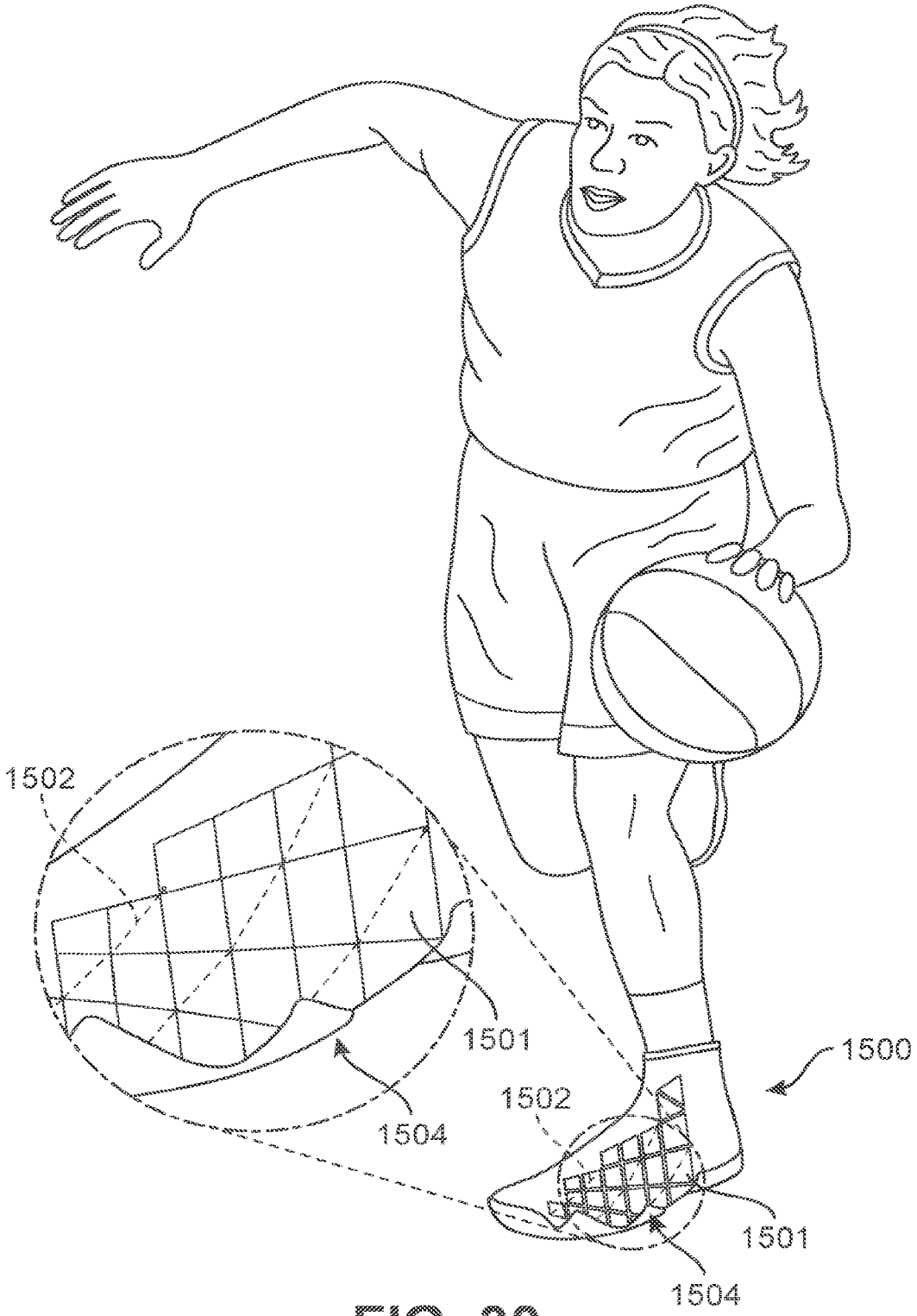
FIG. 30 is an illustration of the example of FIG. 29 in use by a basketball player.

FIG. 30 shows the basketball shoe of FIG. 29 in use by a basketball player. The player is pressing down on the lateral side of her left foot, because she is about to move sharply to the left. Cables 1502 in basketball shoe 1500 are being tightened to compress array of tiles 1504 and thus provide increased support and stability to the basketball shoe. For clarity, the array of tiles 1504 is shown without any fabric covering in FIG. 30. Typically, however, the arrays and rows of tiles in the embodiments described herein may be held between an outer fabric layer and an inner fabric layer.

The blow-up in FIG. 30 shows a close-up view of the array of tiles 1504 after the array has been fully compressed. Because the basketball player is leaning to the left, and pressing down hard on the lateral side of her shoe, the array 1504 of tiles has been fully compressed, as shown in the blow-up.

Figure 31:
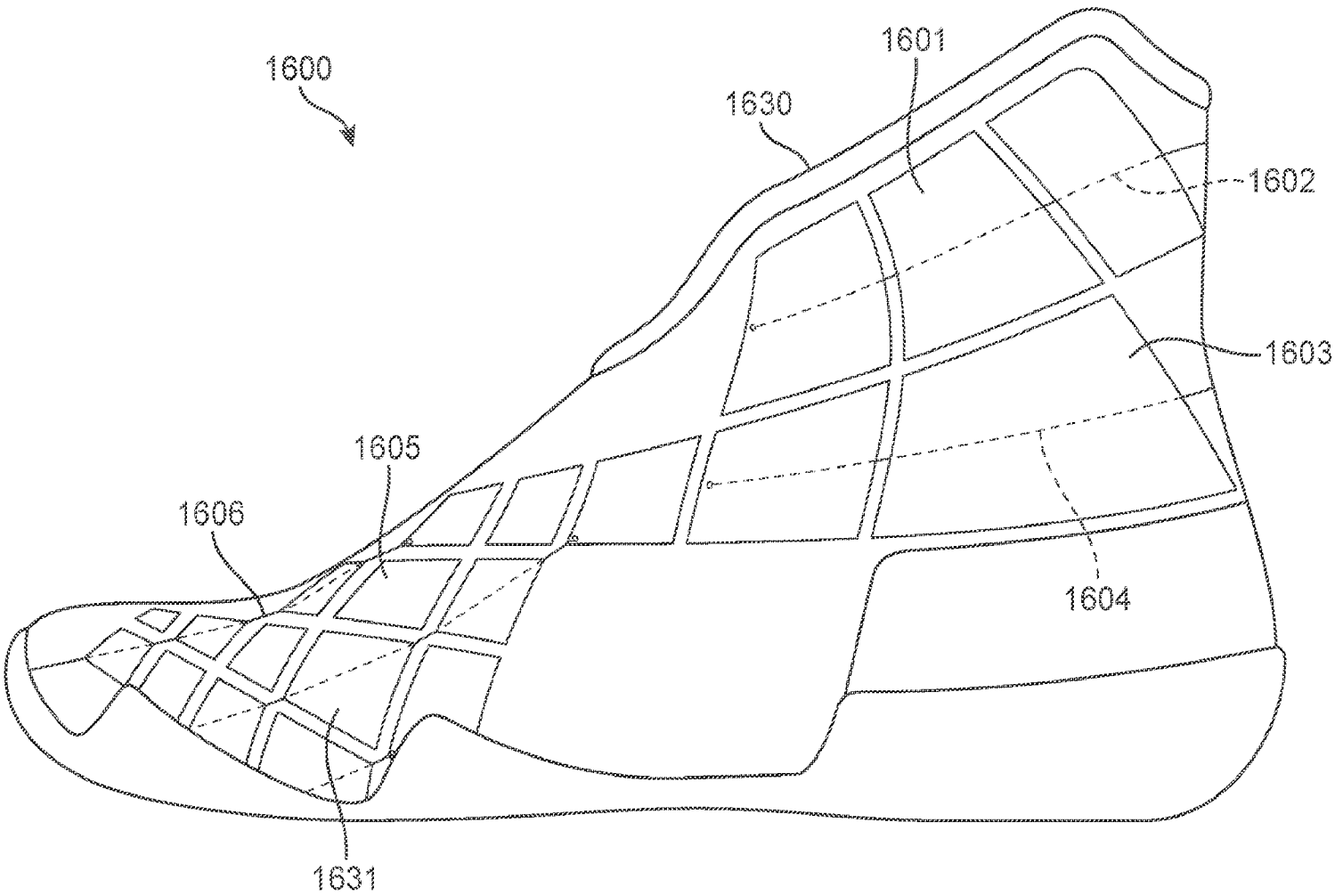
FIG. 31 is a schematic diagram of an embodiment of the dynamic support system applied to a cross-training shoe.

FIG. 31 illustrates an article of footwear that may be used by a person who engages in a variety of different cross-training exercises during one session, such as weight-lifting, working on a rowing machine and running on a treadmill. Such a person may need footwear capable of reacting differently during different activities. Footwear 1600 has a row of tiles 1601 towards the top of the ankle opening 1630 with a cable 1602 laced through the tiles. It also has a second row of tiles 1603 below the first row of tiles, with a cable 1604 laced through the tiles. Footwear 1600 also has an array of tiles 1605 in the forefoot 1631 of footwear 1600, with cables 1606 laced through the tiles.

Figure 32:
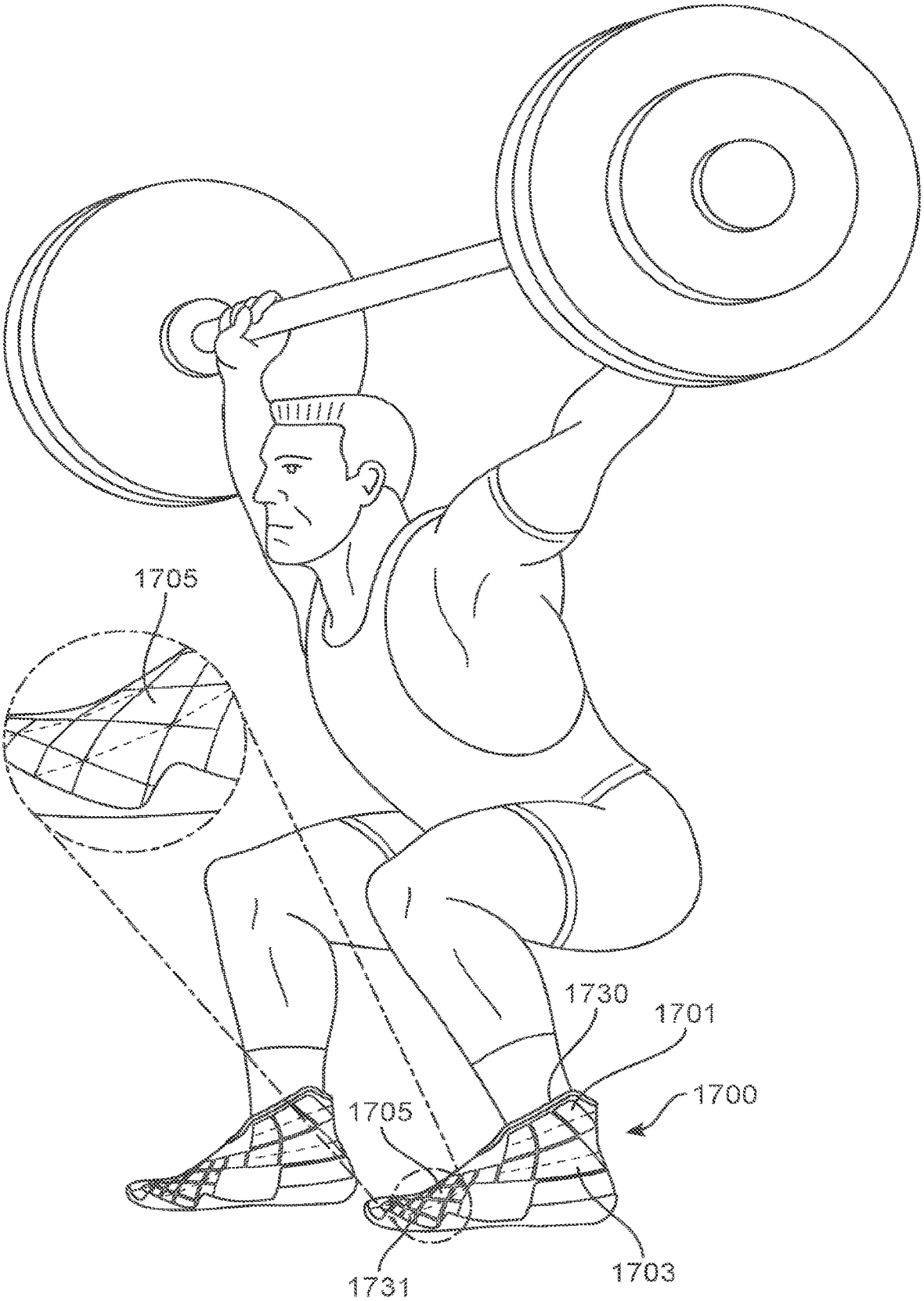
FIG. 32 is an illustration of the embodiment of FIG. 31 in use by a person lifting weights.

FIG. 32 illustrates the article of footwear of FIG. 31 as it is used by a person lifting weights. During this activity, the weightlifter's feet press forward against the toes and the weightlifter needs increased stability around the ankles. Sensors in the sole measure the increased pressure under the toe or forefoot regions and report the level of pressure to a microprocessor in the sole. The microprocessor then activates a motor which acts to compress array of tiles 1705 in forefoot 1731 of footwear 1700. Sensors in the upper measure the increased tension in the upper around the ankle opening an below the ankle, and report the level of tension to a microprocessor in the upper, for example a microprocessor located at the back of the heel. The microprocessor then activates one or more motors to compress the tiles in row 1701 and row 1703, and thus provide increased stability in the region of the upper below ankle opening 1730 of footwear 1700.

The blow-up in FIG. 32 shows a close-up of the array 1705 of tiles. The array is fully compressed in the blow-up because the weightlifter is pressing down on his toes and forefoot as he presses the barbell upwards.

Figure 33:
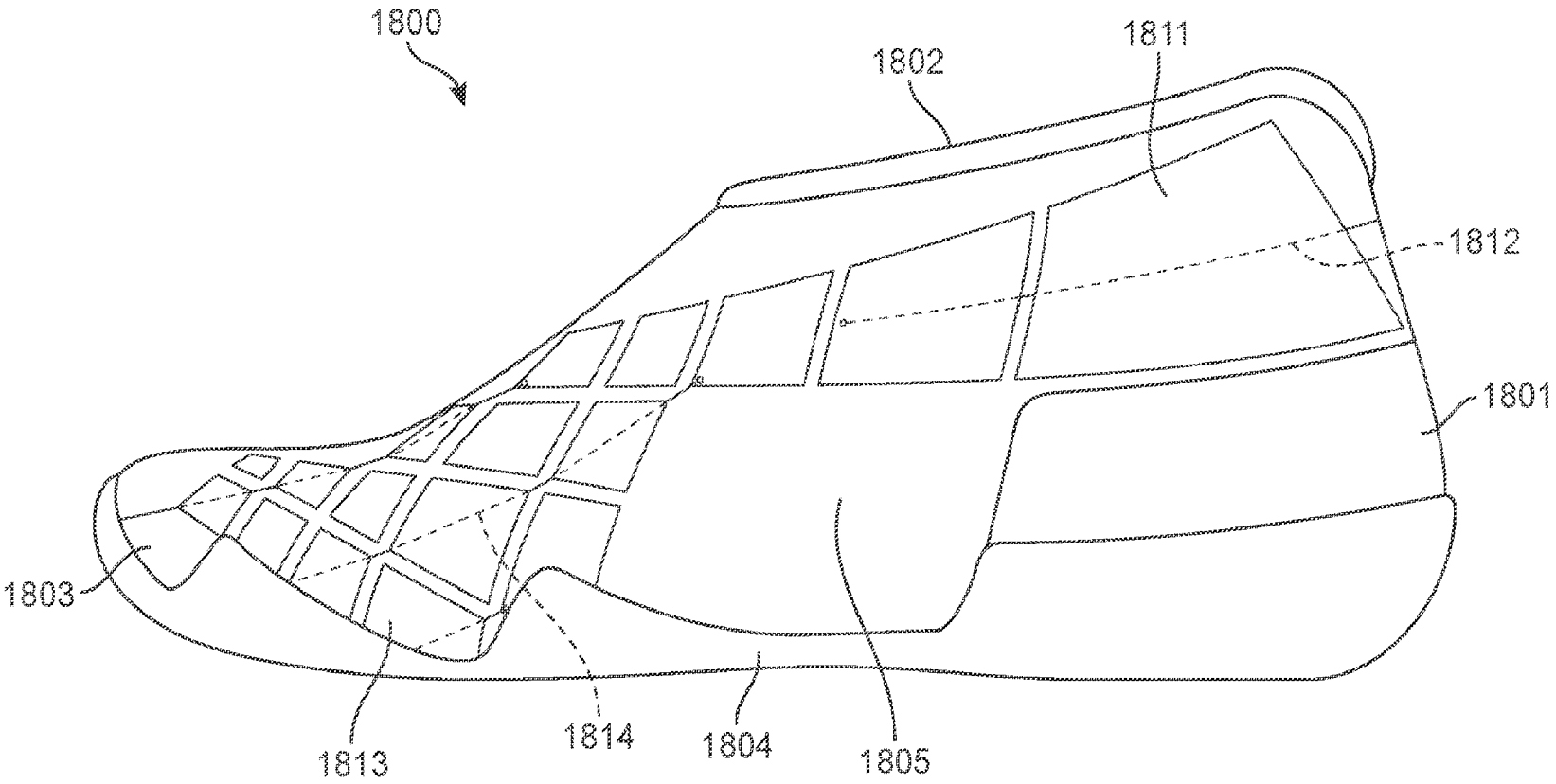
FIG. 33 is a schematic diagram of an embodiment of the dynamic support system applied to a running, jogging or walking shoe.

FIG. 33 illustrates another article of footwear that may be used as a running, jogging or walking shoe. Such a shoe should be comfortable yet provide increased stability when such stability is needed. The embodiment illustrated in FIG. 33 shows a row of tiles 1811 below the ankle opening 1802 of upper 1805 of article of footwear 1800. A motor and reel (not shown) can be used to pull cable 1812 back towards the heel and compress row of tiles 1811 to provide increased support around the ankle (for example when running over an uneven terrain). The motor and reel could be located in the back of heel 1801 of upper 1805. FIG. 33 also shows an array of tiles 1813 in the forefoot region 1803 of upper 1805. A motor and reel (not shown) could be used to pull cables 1814 down towards sole 1804 and compress the array of tiles 1813. The motor and reel for array 1813 could be located, for example, in the toe region of sole 1804.

Figure 34:
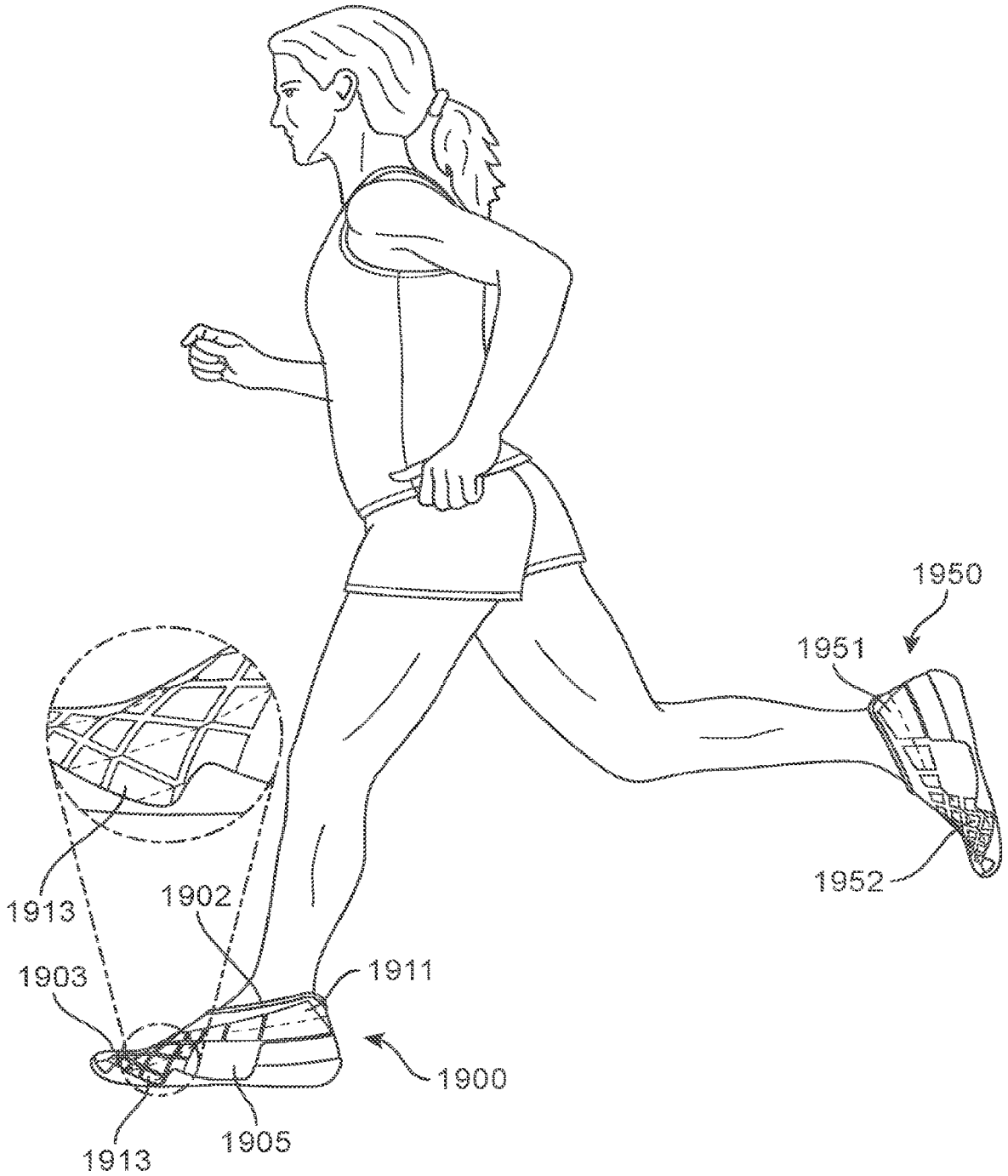
FIG. 34 is an illustration of the embodiment of FIG. 33 in use by a runner.

FIG. 34 illustrates the article of footwear of FIG. 33 as used by a runner. As the runner lands on her left foot, a sensor (not shown) in the sole reports an intermediate level of pressure, and the array of tiles 1913 in the forefoot region 1903 of upper 1905 of left shoe 1900 partially compresses to prevent the runner's foot from sliding within the shoe. The blow-up in FIG. 33 shows a close-up of the partially-compressed array of tiles 1913. Because the runner is running on an even track, the sensors below the ankle opening do not detect tension above a threshold level, and therefore the row of tiles 1911 remains in its uncompressed state. Because right shoe 1950 is in the air, the row of tiles 1951 and the array of tiles 1952 in right shoe 1950 are also in their uncompressed state.

Figure 35:
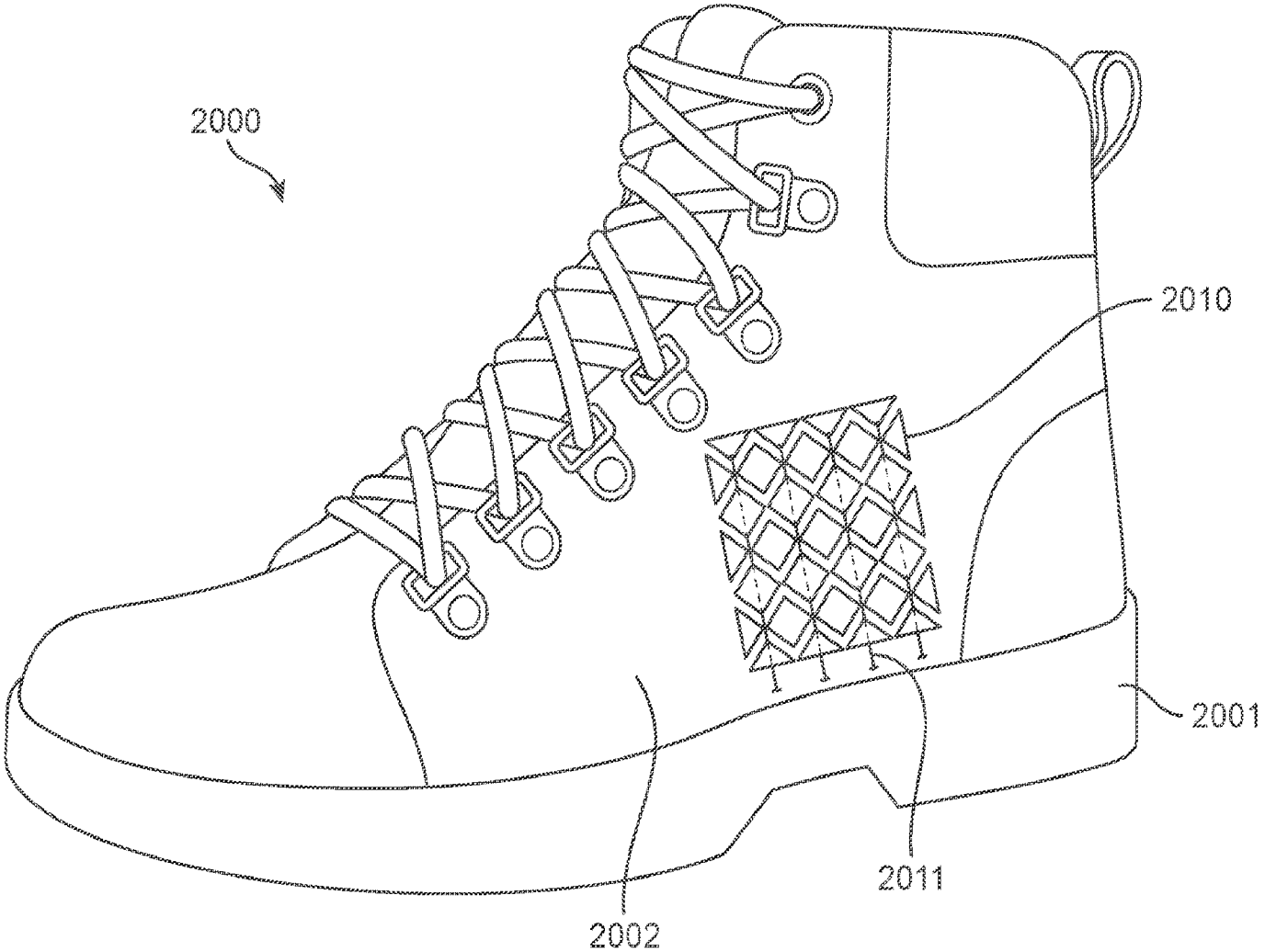
FIG. 35 is a schematic diagram of an embodiment of the dynamic support system applied to a hiking boot.

FIG. 35 is a schematic illustration of a hiking boot 2000. It has an array 2010 of tiles on the lateral side of the upper 2002 of boot 2000, as well as a complementary array of tiles on the medial side of boot 2000 (not shown). Cables 2011 can be used with a motor and reel to compress array of tiles 2010, as in the examples shown in FIG. 11. The motor and reel may be located, for example, in sole 2001 of boot 2000.

Figure 36:
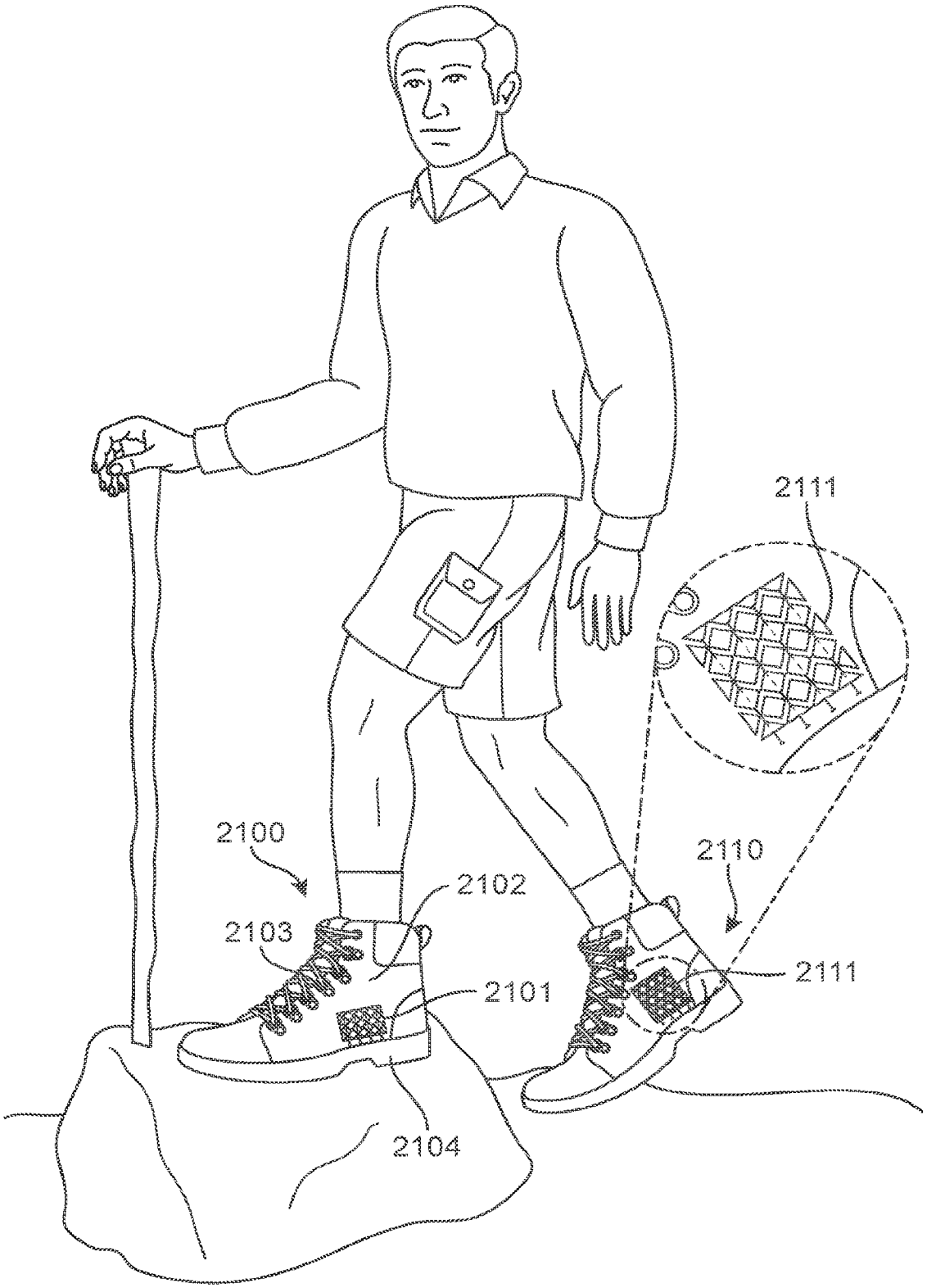
FIG. 36 is an illustration of the embodiment of FIG. 35 in use by a hiker.

FIG. 36 is an illustration of the hiking boot of FIG. 35 in use. The hiker's left foot is on a downward slanting surface of a small boulder. In response to increased tension in the region of upper 2102 between eyelets 2103 and heel 2104, array 2101 has been compressed. In contrast, array 2111 in right boot 2110 is not compressed, as shown in the blow-up in FIG. 36, because the sensor in the upper of right boot 2110 has not detected a level of tension above a predetermined threshold level.

Figure 37:
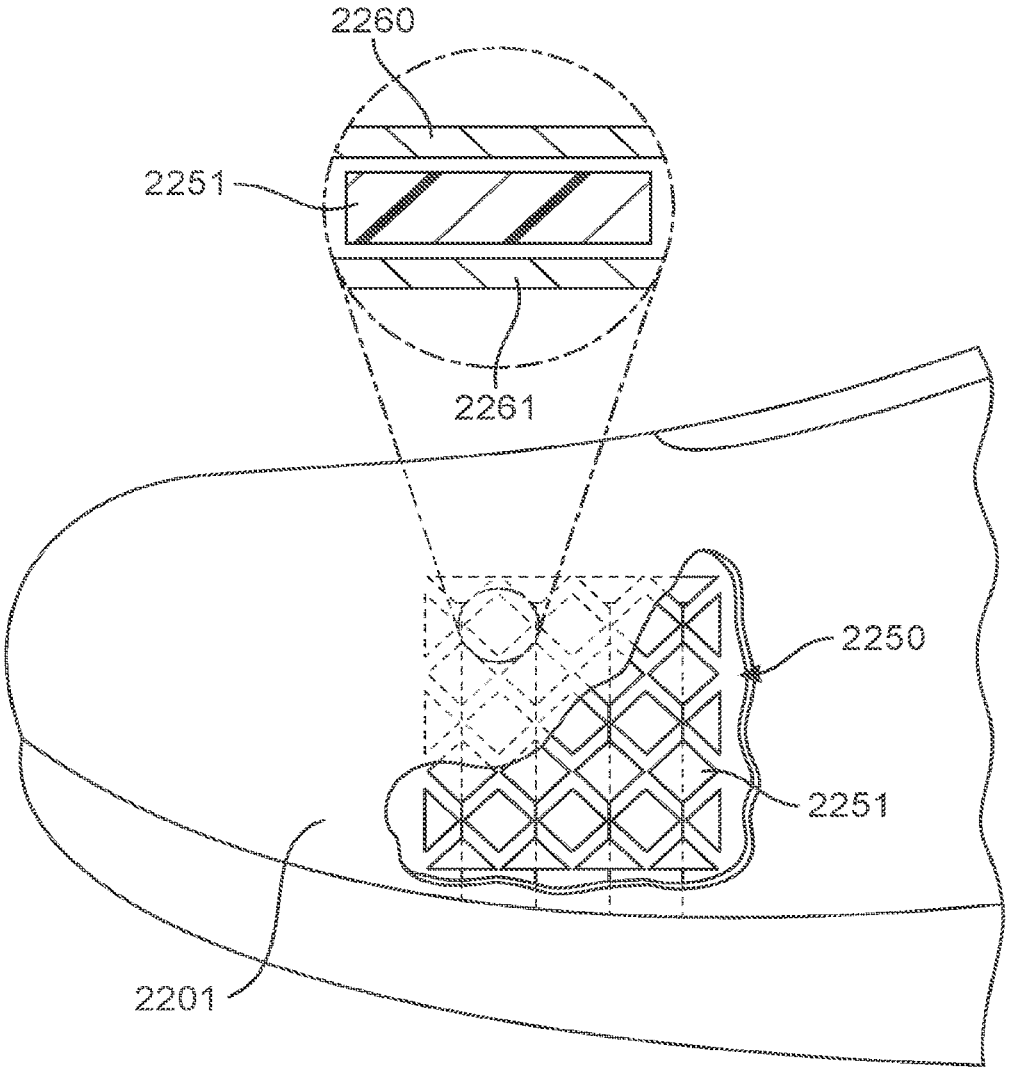
FIG. 37 is a schematic diagram showing how an array of tiles fits between the fabric layers of an article of footwear.

FIG. 37 is a schematic diagram illustrating an example of an array of tiles as the array fits between the fabric layers of an article of footwear. This example shows the forward part of a shoe such as a soccer shoe. This figure shows part of the array 2250 of tiles in phantom, behind an outer layer 2260 (shown in the blow-up). For illustrative purposes, the remainder of the array is exposed in this figure, to more clearly show the array, although in the actual embodiment the outer layer fully covers array 2250 and tiles 2251. This diagram shows an array 2250 of tiles 2251 positioned on the medial side of the forefoot region 2201 of the shoe. The blow-up is a cross-section showing that the array of tiles is held between an outer layer 2260 of fabric and an inner layer 2261 of fabric. In this example, outer layer 2260 may be made from a durable, impact-resistant material, and inner layer 2261 may be made from a material that provides a comfortable feel to the wearer's foot as the foot slides into the shoe.

Accordingly, as discussed above, the various embodiments shown in this disclosure may be used in various recreational and sporting endeavors in order to providing stability and support when needed, but also allow flexibility and comfort when such support is not otherwise needed. As described above, the reel and cable system provides support in specific regions of the upper when the upper is under stress, but returns to a more flexible state when support is not needed.

Although the embodiments depict a dynamic support system for an article of footwear, it is contemplated that other embodiments could include dynamic support systems for other kinds of apparel, including articles of clothing, sports pads and/or other sporting equipment. In particular, the embodiments could be used in combination with any of the article types, as well as the padding systems disclosed in Beers, U.S. Patent Publication Number 2015/0297973, published Oct. 22, 2015, now U.S. Patent Application Number, filed Apr. 22, 2014, and titled "Article of Apparel with Dynamic Padding System," the entirety of which is herein incorporated by reference.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A system, comprising:

an article of footwear, including:

a sole;

an upper;

a motor;

a spool configured to be rotated by the motor; and at least one sensor coupled to the motor;

a wearable article, different than the article of footwear, configured to be worn by a wearer of the article of footwear and including at least one sensor located in the wearable article;

wherein the article of footwear further comprises a microprocessor in communication with the at least one sensor located in the article of footwear and with the at least one sensor located in the wearable article;

wherein the microprocessor is configured to receive a first input from the sensor located in the article of footwear and a second input from the sensor located in the wearable article over a personal-area network and respond to at least one of the first input and the second input by determining whether to activate the motor to rotate the spool to compress a fabric portion of the article of footwear;

wherein the wearable article is one of a head band, a wrist band, a knee pad, and ankle wrap, a shirt, a pair of shorts and a pair of pants.

2. The system of claim 1, wherein the sensor located in the article of footwear is one of a pressure sensor located in the sole and a tension sensor located in the upper; and wherein the sensor located in the wearable article is a motion sensor.

3. The system of claim 2, wherein the motion sensor is an accelerometer.

4. The system of claim 3, wherein when the microprocessor is configured to:

receive data from the accelerometer; and determine whether to activate the motor to compress an array of tiles in the fabric portion of the article of footwear.

5. A system, comprising:

an article of footwear, including:

a sole;

an upper;

a motor;

a spool configured to be rotated by the motor; and at least one sensor coupled to the motor;

a wearable article, different than the article of footwear, configured to be worn by a wearer of the article of footwear and including at least one sensor located in the wearable article;

wherein the article of footwear further comprises a microprocessor in communication with the at least one sensor located in the article of footwear and with the at least one sensor located in the wearable article;

wherein the microprocessor is configured to receive a first input from the sensor located in the article of footwear and a second input from the sensor located in the wearable article over a personal-area network and respond to at least one of the first input and the second input by determining whether to activate the motor to rotate the spool to compress a fabric portion of the article of footwear;

wherein the article of footwear is a first article of footwear and further comprising a second article of footwear, wherein the second article of footwear includes at least one sensor and at least a second microprocessor.

6. The system of claim 5, wherein the second microprocessor is configured to receive data from at least one sensor of the second article of footwear and wirelessly communicate that data to the microprocessor of the first article of footwear.

7. The system of claim 5, wherein the sensor located in the article of footwear is one of a pressure sensor located in the sole and a tension sensor located in the upper; and wherein the sensor located in the wearable article is a motion sensor.

8. The system of claim 7, wherein the motion sensor is an accelerometer.

9. The system of claim 8, wherein when the first microprocessor is configured to:

receive data from the accelerometer; and determine whether to activate the motor to compress an array of tiles in the fabric portion of the article of footwear.

10. A system, comprising:

an article of footwear, including:

a sole;

an upper;

a motor;

a spool configured to be rotated by the motor; and at least one sensor coupled to the motor;

a wearable article, different than the article of footwear, configured to be worn by a wearer of the article of footwear and including at least one sensor located in the wearable article;

wherein the article of footwear further comprises a microprocessor in communication with the at least one sensor located in the article of footwear and with the at least one sensor located in the wearable article;

wherein the microprocessor is configured to receive a first input from the sensor located in the article of footwear and a second input from the sensor located in the wearable article over a personal-area network and respond to at least one of the first input and the second input by determining whether to activate the motor to rotate the spool to compress a fabric portion of the article of footwear;

wherein the article of footwear further comprises an array of tiles including columns and rows of tiles and wherein at least two cables are laced diagonally through the tiles and engaged by the spool, wherein the array of tiles is configured to compress the fabric portion.

11. The system of claim 10, wherein the array of tiles is located in a forefoot region of the fabric portion of the article of footwear, and the sensor is located in a big toe region of the fabric portion of the article of footwear.

12. The system of claim 11, wherein a plurality of cables is laced through alternate columns of tiles and alternate rows of tiles and engaged by the spool.

13. The system of claim 10, wherein the sensor located in the article of footwear is one of a pressure sensor located in the sole and a tension sensor located in the upper; and wherein the sensor located in the wearable article is a motion sensor.

14. The system of claim 13, wherein the motion sensor is an accelerometer.

15. The system of claim 14, wherein when the microprocessor is configured to:

receive data from the accelerometer; and determine whether to activate the motor to compress an array of tiles in the fabric portion of the article of footwear.

* * * * *